United States Patent [19]

Hargest

[11] Patent Number: 5,036,559

[45] **Date of Patent: * Aug. 6, 1991**

[54] METHOD OF DUAL MODE PATIENT SUPPORT

[75] Inventor: Thomas S. Hargest, Charleston, S.C.

[73] Assignee: SSI Medical Sevices, Inc., Charleston, S.C.

[ * ] Notice: The portion of the term of this patent subsequent to Jul. 24, 2007 has been disclaimed.

[21] Appl. No.: 446,987

[22] Filed: Dec. 6, 1989

Related U.S. Application Data

[63] Continuation-in-part of Ser. No. 288,071, Dec. 20, 1988, Pat. No. 4,942,635.

[51] Int. Cl.[5] ..... A47C 27/10; A61G 7/057

[52] U.S. Cl. ..... 5/453; 5/455

[58] Field of Search ..... 5/453, 455, 449, 469, 5/450

[56] References Cited

U.S. PATENT DOCUMENTS

| | | | |
|---|---|---|---|
| 3,428,973 | 2/1969 | Hargest et al. | 5/449 |
| 3,866,606 | 2/1975 | Hargest | 5/453 |
| 4,483,029 | 11/1984 | Paul | 5/453 |
| 4,564,965 | 1/1986 | Goodwin | 5/453 |
| 4,599,755 | 7/1986 | Tominaga | 5/453 |
| 4,637,083 | 1/1987 | Goodwin | 5/453 |
| 4,672,699 | 6/1987 | Goodwin | 5/430 |
| 4,694,520 | 9/1987 | Paul et al. | 5/453 |
| 4,694,521 | 9/1987 | Tominaga | 5/453 |
| 4,745,647 | 5/1988 | Goodwin | 5/453 |
| 4,768,249 | 9/1988 | Goodwin | 5/453 |
| 4,962,635 | 7/1990 | Hargest et al. | 5/455 |

*Primary Examiner*—Alexander Grosz

*Attorney, Agent, or Firm*—Dority & Manning

[57] ABSTRACT

A patient's head, chest and upper torso are supported on a first surface formed by a plurality of inflatable sacks disposed on an articulatable member. The patient's lower torso, buttocks, legs and feet are supported on a second surface formed by air fluidizing a mass of fluidizable material. A blower inflates the sacks and the fluidizable material via a network including manifolds, valves, and flexible tubing. A microprocessor controls actuation of the articulatable member, the various valves, and the blower, according to signals inputted by operating personnel or supplied by various monitoring sensors. The flow of air to the fluidizable material beneath the buttocks of the patient is reduced when the articulatable member is raised, thus increasing the density of support beneath the patient's buttocks and counteracting the tendency of the shifting weight of the patient's upper body to slide the patient toward the foot of the bed. Once the patient's upper body has reached the desired inclined position, the fluidizable material is briefly refluidized to contour the mass of material that is disposed for supporting the patient's buttocks sitting in the mass of fluidizable material.

32 Claims, 10 Drawing Sheets

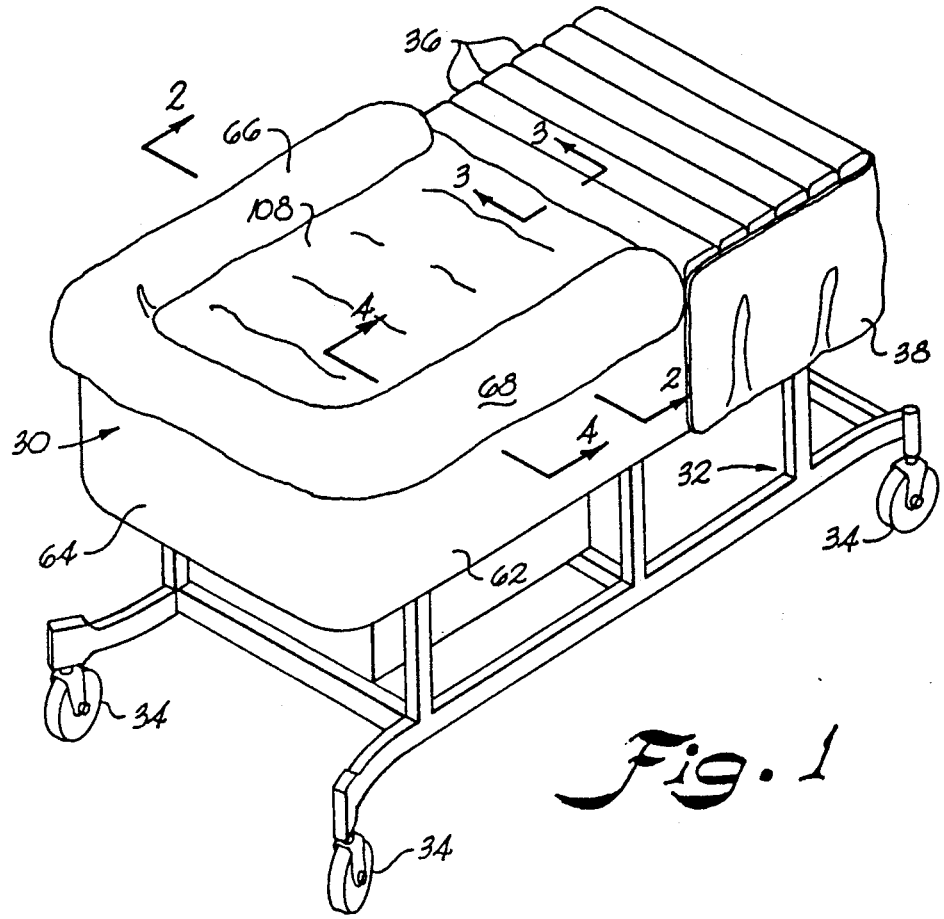
Fig. 1
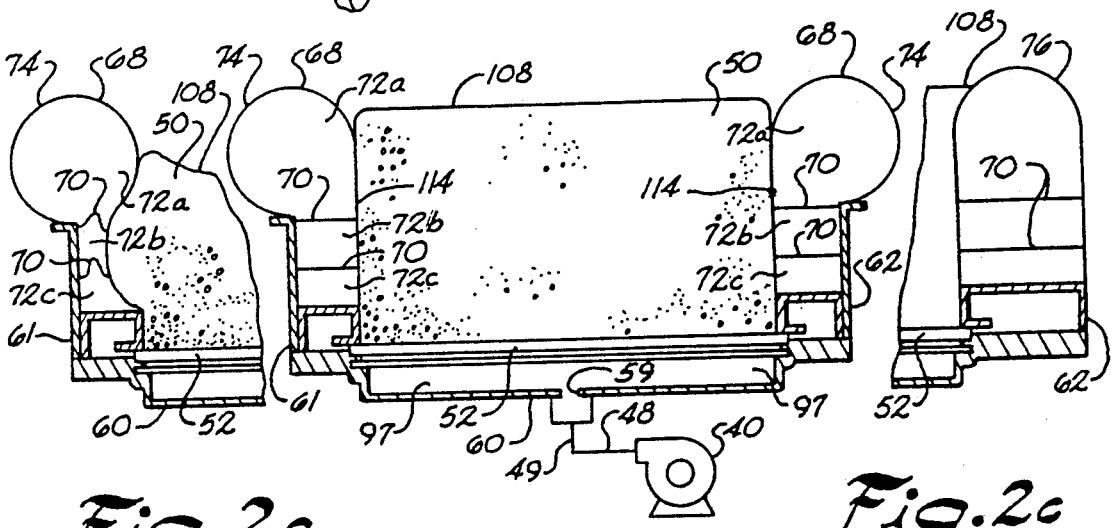
Fig. 2a
Fig. 2c
Fig. 2b

METHOD OF DUAL MODE PATIENT SUPPORT

BACKGROUND OF INVENTION

This is a continuation-in-part application of Ser. No. 07/288,071, filed on Dec. 20, 1988 now U.S. Pat. No. 4,942,635, which is hereby incorporated herein by reference.

The present invention relates to a method of patient support and more particularly to a method of patient support which includes attributes of a method of air fluidized support.

Two types of patient support systems preferred for long-term patient care include air fluidized beds such as those described in U.S. Pat. Nos. 3,428,973 to Hargest et al, 3,866,606 to Hargest, 4,483,029 to Paul, 4,564,965 to Goodwin, 4,637,083 to Goodwin, 4,672,699 to Goodwin, and low air loss beds such as those described in U.S. Pat. Nos. 4,694,520 to Paul et al, 4,745,647 to Goodwin, and 4,768,249 to Goodwin.

Each type has advantages for particular segments of the patient population. For example, patients with respiratory problems require elevation of the chest. However, this tends to cause the patient to slide toward the foot of the bed. Since a fluidized bed in the fluidized condition provides no shear forces against the patient, and some shear forces are provided by the low air loss bed, patient elevation is performed more easily in a low air loss bed. However, to completely overcome sliding to the foot of even the low air loss bed, some sort of knee gatch is required to be fitted to the low air loss bed to provide a surface against which the buttocks of the patient may be retained when the patient's chest is elevated.

Moreover, the same shear forces which assist in retaining the patient in the low air loss bed from slipping to the foot of the bed when the chest is elevated, become undesirable for patients with skin grafts. The shear forces tend to tear such skin grafts from the patient, and this is not only painful but also interrupts the healing process. The absence of shear forces in a fluidized bed permits the patient with skin grafts to move about without fear that the grafts will be torn from the patient's body. In a fluidized bed, the patient can lie on a skin graft and be confident that when the patient moves, the sheet will move with the patient across the supporting mass of fluidized material and not displace the graft as would be the case if the patient were moved across a conventional mattress or a low air loss bed support for that matter.

The large mass of fluidizable material required to sustain operation of a fluidized bed contributes significantly to the weight of the bed. In addition, the large mass of fluidizable material requires a large blower to fluidize the beads, and such blowers require significant amounts of electricity for their operation.

PRINCIPAL OBJECTS AND SUMMARY OF THE INVENTION

It is a principal object of the present invention to provide a method of improved patient support for long-term patient care.

Another principal object of the present invention is to provide a method of supporting at least a portion of a patient on a first surface formed by a mass of fluidizable material while supporting another portion of the patient on a second surface formed by at least one air-inflated sack and wherein the first surface is adjacent the second surface without the two surfaces overlapping one another.

It is a further principal object of the present invention to provide an improved method of patient support that includes fluidized patient support, yet facilitates elevation of the patient's upper body.

It is another principal object of the present invention to provide an improved method of reduced weight fluidized patient support.

A further principal object of the present invention is to provide an improved method of fluidized patient support with reduced overall power requirements of fluidization.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the method of dual mode patient support of the present invention comprises supporting a first portion of the patient on a first surface. Typically, the first portion of the patient includes the upper torso, chest, and head of the patient. The first surface can be formed by a rigid flat surface, a conventional mattress, or at least one air-inflatable sack. Preferably, the first portion of the patient is supported on the upper surfaces of a plurality of inflatable sacks which have been disposed across and carried by an articulatable section of a conventional bed frame, and particularly the articulatable head section of the bed frame. The sacks preferably are inflated with pressurized air. Preferably, pressure is maintained in the air sacks and other inflatable components of the support system by connecting a blower via one or more flow control valves to an air sack manifold which supplies air to one or more pressure control valves via one or more flexible air conduits. Each valve preferably has a pressure sensing device that measures the pressure at the outlet of the valve, which can be opened or closed to varying degrees by a motor. A microprocessor receives pressure information from the pressure sensing device of each valve and controls the motor to open or close the valve according to an operational program. Various operational programs are stored by the microprocessor and can be selected by the operator via a keypad and control panel that enables the operator to interact with the microprocessor. The microprocessor also controls the blower via a blower control board that receives signals from a pressure sensor which monitors the pressure at the outlet side of the blower.

In further accordance with the present invention, a different portion of the patient preferably is supported on a second surface formed by an air fluidizable mass of material. The fluidizable mass of material preferably includes tiny spheres formed of glass, ceramics, or silicon. The different portion of the patient preferably includes the buttocks of the patient and typically includes the patient's lower torso, legs and feet. As embodied herein, this preferably is accomplished by using a device that adjoins a fluidizable surface with the first surface. Preferably, the frame which carries the first surface also carries means for containing a fluidizable mass of material and for permitting the diffusion of air therethrough. The containing means preferably includes a tank and a diffuser board, which covers the bottom of the tank and is permeable to air but impermeable to the fluidizable medium. The walls of the tank can be at least partially replaced by or lined along the interior by an elastic retaining means which provides lateral retention of the mass of fluidizable material yet is vertically and elastically collapsible at least in part. The fluidizable material rests atop the diffuser board, and against the collapsible lateral retaining means which is secured to the diffuser board in airtight fashion. The tank can be similar to what is used in a conventional fluidized patient support system, which typically includes an air permeable sheet covering the fluidizable material and providing a patient support surface as well as retaining the tiny particles within the tank during the passage of fluidizing air through the fluidizable material. The cover sheet encloses the fluidizable material by being connected to the retaining means in a fashion that is impermeable to the passage of air and fluidizable material.

The diffuser board preferably has at least two tiers disposed at two different levels above the bottom of the tank, which is subdivided into at least two chambers that are separately pressurizable from one another. One tier is disposed to support the fluidizable material that supports the patient's buttocks, and this tier is closer to the bottom of the plenum and therefore supports a relatively larger depth of fluidizable material than the second tier, which supports the fluidizable material beneath the legs and feet of the patient. The reduced depth of material for supporting the legs and feet of the patient reduces the weight of the system. It also enables use of a smaller blower to fluidize the mass of material, and this lowers the power requirements of the system as well as further reducing the weight of the system.

Preferably, the first surface is adjacent to the second surface. The tank preferably is disposed next to the first surface, and the end of the tank adjoining the first surface preferably is at least partially open to receive therein means for elastically retaining the fluidizable material in the tank and for interfacing with the first surface. One end of the first surface preferably is coterminous with one end of the second surface so that the first surface picks up support of the patient where the second surface leaves off. The two surfaces preferably do not overlap one another.

In further accordance with the present invention, the first portion of the patient is inclined by elevating one end of the first surface. As embodied herein, the first surface is itself supported by an articulatable member that has an articulatable joint so as to be capable of being inclined by elevating the free end of the articulatable member. The free end of the first surface pivots about the joint located preferably beneath the other end of the first surface, which other end is between the first surface and the second surface. Typically, the head and chest of the patient is supported on an articulatable section of a frame that supports the first surface. The free end of the first surface typically is the end closest to the head of the patient. Conventional hydraulics and motors are used to effect inclination of the first surface, and these hydraulics and motors are monitored and controlled by a microprocessor, which in turn is subject to operator control via the keypad of a control panel. A sensing device detects the degree to which the articulatable section has been inclined and accordingly signals this information to the microprocessor.

In further accordance with the present invention, the level of fluidization of the mass of fluidizable material is reduced preferably either before or during elevation of the first surface supporting the first portion of the patient's body. During elevation of the first surface, the level of fluidization can be reduced gradually to a fixed lower level of fluidization or to complete defluidization. Alternatively, the mass of material can be completely defluidized before inclination of the first surface begins or during the initial process of such inclination.

As embodied herein, the defluidization step preferably is accomplished with the aid of the sensing device which monitors the degree of articulation of the articulatable member and furnishes this information to a microprocessor which controls the supply of air used to fluidize the fluidizable material. The operator selects the degree of elevation of the one end of the first surface via a key pad of a control panel, and the microprocessor then activates the hydraulics and motors until the articulation sensing device signals that the desired level of articulation has been attained. In conjunction with the elevation of the articulatable first surface, the microprocessor closes the flow control valve that governs the supply of air to fluidize the mass of fluidizable material beneath the buttocks of the patient. This changes the supply of air to the mass of fluidizable material supporting the buttocks of the patient and thus defluidizes same. This reduction in the air supply occurs either immediately, gradually over time, or prior to initiating inclination of the first surface, as preselected, depending on how the microprocessor has been programmed to close the appropriate flow control valve. The defluidized material beneath the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee gatch that often is required when elevating the head and chest of a patient in a conventional bed. The prevention of movement of the buttocks provides the additional benefit of restraining the patient from any slipping and sliding that might cause tissue damage to any sacral skin grafts which may exist on the patient.

In still further accordance with the present invention, the rate of defluidization that occurs during elevation of the first surface can be regulated so as to restrain the buttocks of the patient from moving in a direction toward the feet of the patient as weight is transferred against the buttocks. This preferably can be accomplished by the elevation sensing device and the microprocessor, which regulates the air supplied to the fluidizable material supporting the buttocks. For this purpose, the microprocessor could rely on an algorithm that relates the instantaneous angle of elevation above the horizontal with the size, primarily height since this information is normally readily available, and weight of the patient. Other factors which might be used to refine this correlation, can include the particle size and mass of the fluidizable material, the depth of fluidizable material beneath the buttocks of the patient, the initial level of fluidization, and the rate of elevation of the articulatable first surface. Similarly, the parameters of the algorithm can be adjusted so that the control effected by the microprocessor produces a restraint of the buttocks that prevents the kind of slipping or sliding that results in tissue damage to existing sacral skin grafts on the patient. However, in an alternative preferred embodiment, the rate of defluidization occurs rapidly enough so that the mass of material has been completely defluidized before the first surface begins elevating.

In still further accordance with the present invention, the mass of fluidizable material is briefly refluidized after the first surface has ceased being inclined. As embodied herein, this step preferably is accomplished with the aid of the microprocessor. After the articulatable first surface has attained the desired angle of elevation, the microprocessor briefly opens and closes the flow control valve that governs the supply of air that fluidizes the mass of fluidizable material beneath the buttocks of the patient. This causes a brief fluidization of the fluidizable material supporting the buttocks of the patient. The duration of this brief fluidization is preferably no longer than is required to contour the mass of fluidizable material supporting the buttocks in the sitting position. The fluidization is brief enough so that the patient does not feel the sensation of sinking into the mass of fluidizable material in the buttocks zone during defluidization. Preferably the duration of the brief fluidization is on the order of between one half (½) second and one and one half (1½) seconds. If desired, the exact duration of the brief fluidization could be calculated by the microprocessor according to an algorithm. The time calculated by the algorithm could be made to vary depending upon primarily the angle of inclination of the first surface and the height and weight of the patient.

The accompanying drawings which are incorporated in and constitute a part of this specification, illustrate apparatus for practicing the invention and, together with the description, assist in explaining the principles of the invention.

BRIEF DESCRIPTION OF THE DRAWINGS

FIG. 1 illustrates a perspective view of an embodiment for practicing the present invention;

FIG. 2*a* illustrates a partial cross-sectional view of components for practicing the present invention in a defluidized state taken along a view similar to that taken along the lines 2—2 of FIG. 1;

FIG. 2*b* illustrates a cross-sectional view of components for practicing the present invention in a fluidized state taken along the lines 2—2 of FIG. 1;

FIG. 2*c* illustrates a partial cross-sectional view of components for practicing the present invention in a fluidized state taken in a direction similar to the lines 2—2 of FIG. 1;

DETAILED DESCRIPTION OF THE PREFERRED EMBODIMENTS

Reference now will be made in detail to the present preferred embodiments of the present invention, one or more examples of which are explained with the aid of the accompanying drawings. Each example is provided by way of explanation of the invention, not limitation of the invention. In fact, it will be apparent to those skilled in the art that various modifications and variations can be made in the disclosed embodiments of the present invention without departing from the scope or spirit of the invention. For instance, features illustrated or described as part of one embodiment, can be used with another embodiment to yield a still further embodiment. Thus, it is intended that the present invention cover the modifications and variations of this invention provided they come within the scope of the appended claims and their equivalents.

Figure 10:
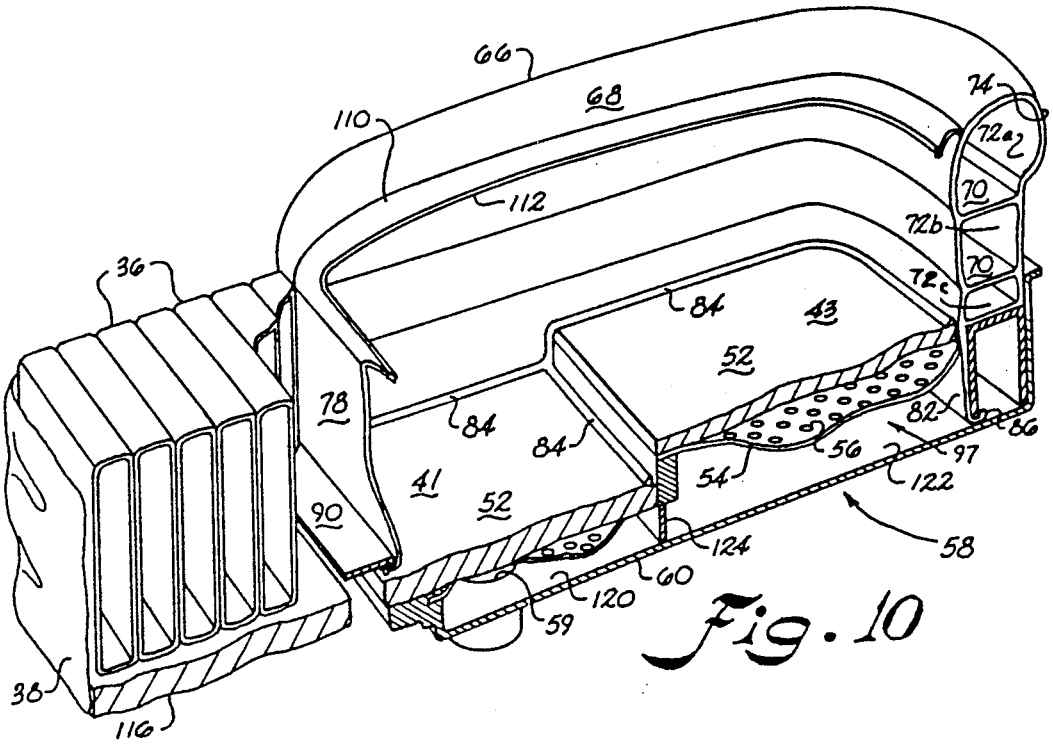
FIG. 10 illustrates a perspective, cut-away view of components for practicing the present invention.
Figure 11:
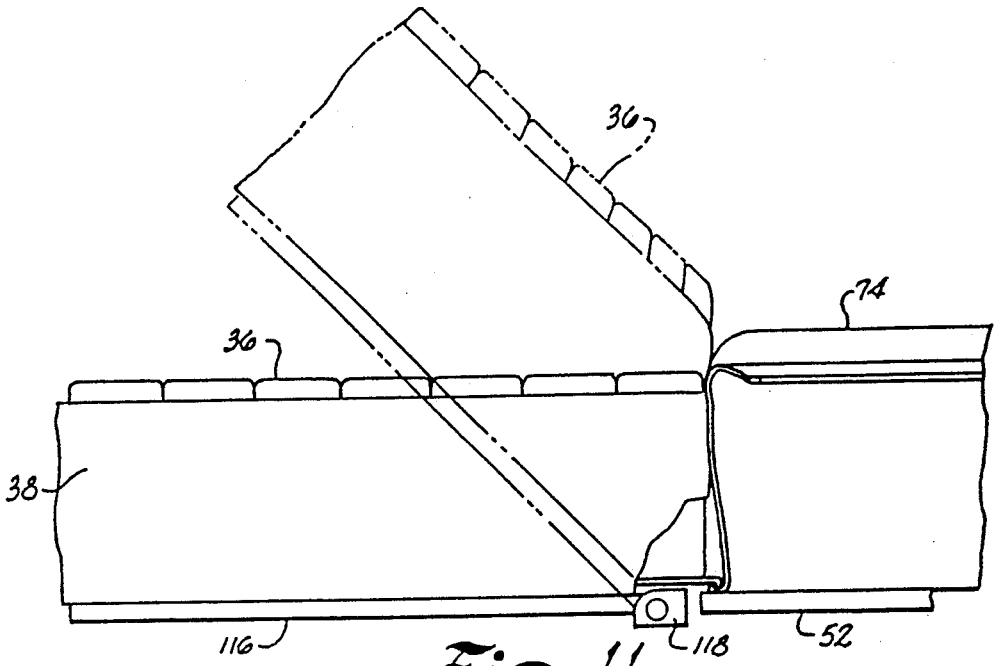
FIG. 11 illustrates a side, partially cut-away, plan view of components for practicing the present invention.

In accordance with the method of the present invention of providing support to a patient, a first portion of the patient is supported on a first surface. As embodied herein, the first portion of the patient preferably is that portion of the patient above the patient's waist and therefore includes the upper torso, chest, and head of the patient. However, in an alternative embodiment of the invention, the first portion of the patient can include the portion of the patient below the waist. As embodied herein, the first surface can be formed by a rigid flat surface, or a conventional mattress, or at least one air-inflatable sack. FIG. 1 illustrates an embodiment of a dual mode patient support system for practicing the method of the present invention. This embodiment is represented generally by the numeral 30 and is described in more detail hereinafter, especially as it relates to practice of the method of the present invention. A patient support system for practicing the method of the present invention typically would include a frame which is indicated generally in FIG. 1 by the designating numeral 32. As shown in FIGS. 10 and 11 for example, frame 32 preferably includes an articulatable member 116. Conventional means such as hydraulics and motors are provided to raise and lower the articulatable member, which pivots about an articulation joint 118. Preferably, member 116 has a range of inclination from about 0° to about 60° from the horizontal.

Figure 14:
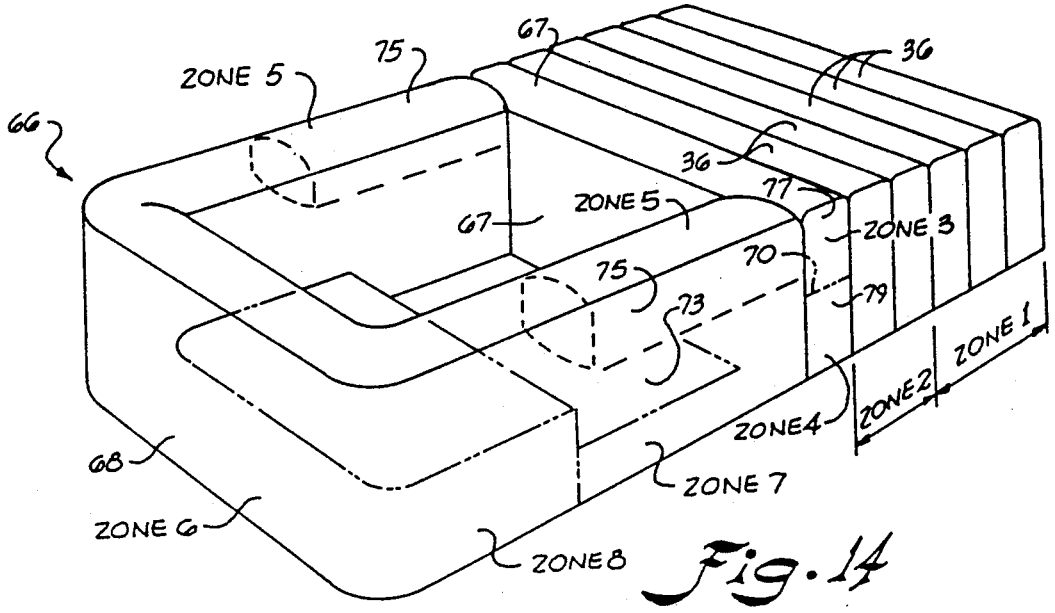
FIG. 14 illustrates a perspective, schematic view of components for practicing the present invention.

Preferably, and as shown for example in FIGS. 1, 10 and 14, the first portion of the patient is supported on the upper surfaces of a plurality of inflatable sacks 36 which have been disposed across and carried by an articulatable section 116 of a conventional bed frame, and particularly the articulatable head section of the bed frame. Sacks 36 preferably are inflated with pressurized air. Inflatable sacks 36 preferably are covered by a conventional hospital sheet and/or other bedding (not shown). The upper surfaces of the sacks provide a generally firm, air pressurized flat upper surface for supporting the patient. The shape of the sacks is flexible and permits the upper surfaces of the sacks to become configured so as to have enough surface area supporting the patient to equilibrate the internal and external pressure on the sack surface.

In further accordance with the method of the present invention, a different portion of the patient is supported on a second surface formed by an air fluidizable mass of material. The different portion of the patient preferably includes at least the buttocks of the patient and typically includes the patient's lower torso, legs and feet. Preferably, a fluidizable medium is carried by the frame to support at least the buttocks of the patient. As embodied herein and shown in FIGS. 2*a*, 2*b*, 4, 8, 9, 12*a*, 12*b*, and 12*c* for example, a plurality of tiny particles 50 forms a fluidizable medium. Each particle 50 preferably is formed as a sphere having a diameter on the order of one thousandth of an inch and more particularly in the range of about 50 microns to about 150 microns. Suitable materials for forming particles 50 include ceramics, glass, and silicon. Preferably, a silicon coating is applied to a ceramic bead or to a glass bead.

While the second surface supports a different portion of the patient's body than is supported by the first surface, usually there will be enough continuity between the first and second surface so that the patient does not sense any discontinuity between the two support surfaces. As embodied herein and shown in FIG. 1 for example, a plurality of air inflatable sacks 36 adjoin with the tank that confines the mass of fluidizable material beneath an air permeable sheet 108 shown in FIG. 1. The same sort of arrangement is shown FIGS. 10 and 14 for example. The difference in the embodiments shown in these latter two figures basically concerns the nature of the interfacing components that separate the mass of fluidizable material from air inflatable sacks 36. However, the first surface formed by the sacks is adjacent the second surface formed by the fluidizable material without any overlap between the two surfaces. Preferably, one end of the first surface is coterminous with one end of the second surface. However, various components such as an interface sack 67 shown in FIG. 14 for example and a flexible panel 78 shown in FIG. 10 for example may be disposed between the first and second surfaces or may be considered part of one or the other of the first and second surfaces.

In accordance with the method of the present invention, the first portion of the patient is inclined by elevating one end of the first surface. As embodied herein, microprocessor 130 controls articulation of articulatable member 116 via conventional hydraulics and motors indicated schematically in FIG. 13 by the articulation package designated 152. Sensing devices also are included in this articulation package 152, as indicated schematically in FIG. 13 by the return arrow toward microprocessor 130. These sensing devices provide microprocessor 130 with information regarding the degree of articulation of articulatable member 116. Instructions concerning the degree of elevation of articulation member 116 are inputted to microprocessor 130 by the operator via key pad 154 and control panel 156. Microprocessor 130 then activates the conventional hydraulics and motors until the articulation sensing device signals that the inputted level of articulation has been attained.

In yet further accordance with the method of the present invention, the level of fluidization of the mass of fluidizing material forming the second surface is reduced in association with the elevation of one end of the first surface. Means are provided for reducing the level of fluidization of the mass of fluidizable material during elevation of one end of the first surface. As embodied herein and shown schematically in FIG. 13 for example, the means for reducing the fluidization level of the mass of fluidizable material during elevation of one end of the first surface preferably includes articulation package 152 and microprocessor 130. As embodied herein, articulation package 152 contains conventional sensing devices to monitor the degree of articulation of the first surface, which preferably is formed by an articulatable member 116. In conjunction with the actuation of the conventional hydraulics and motors to begin elevating the free end of articulatable member 116, microprocessor 130 causes flow control valve 126 governing fluidization of buttocks plenum chamber 120 (shown in FIG. 10 for example) to close. This completely defluidizes the mass of fluidizable material supporting the buttocks of the patient and so reduces the level of fluidization to zero. Thus, the defluidization of the second surface preferably affects at least the portion of the second surface that supports the buttocks of the patient. This increases the density and viscosity of the beads supporting the buttocks and accordingly counteracts the tendency of the shifting weight of the patient's upper body to slide the patient toward the foot of the patient support system. Moreover, the defluidization of the second surface can occur over the portions of the second surface that support portions of the patient other than the buttocks, for example those portions supporting the legs and feet of the patient.

Preferably, the reduction in the level of fluidization of the fluidizable mass of material occurs rapidly and before elevation of the first surface actually begins. Moreover, such reduction preferably results in complete defluidization of the mass of fluidizable material. Alternatively, the reduction in the level of fluidization can proceed until a fixed lower level of fluidization has been attained that maintains some lower level of fluidization rather than complete defluidization. Alternatively, the mass of material 50 can be gradually defluidized during inclination of the first surface, and defluidization can be substantially completed during the initial stages of such inclination.

The defluidization of material 50 supporting the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee gatch that often is required when elevating the head and chest of a patient on the articulatable member of a conventional low air loss bed. The prevention of movement of the buttocks has the added beneficial result of restraining the patient from any slipping and sliding that might cause tissue damage to any sacral skin grafts which may exist on the patient.

In still further accordance with the present invention, the rate of defluidization that occurs during elevation of the first surface can be regulated so as to restrain the buttocks of the patient from moving in a direction toward the feet of the patient as weight is transferred against the buttocks. This preferably can be accomplished by the microprocessor according to an algorithm that relates the instantaneous angle of elevation above the horizontal with the size and weight of the patient. Other factors can be used to refine this correlation. Such other factors can include the particle size and mass of the fluidizable material, the depth of fluidizable material beneath the buttocks of the patient, the level of fluidization, and the rate of elevation of the articulatable first surface. Moreover, the parameters of the algorithm can be adjusted so that the restraint of the buttocks prevents slipping or sliding that results in tissue damage to existing sacral skin grafts on the patient.

In yet further accordance with the present invention, upon ceasing to elevate the first surface, the mass of fluidizable material is refluidized for a brief period. As embodied herein, the sensing devices that monitor the degree of articulation of member 116, signal microprocessor 130 that the desired angle of elevation has been attained. Whereupon, microprocessor 130 preferably is programmed to signal flow control valve 126 to open for a very brief period of time. The duration of this brief period is no longer than required to contour the mass of fluidizable material for supporting the buttocks in the sitting position which has been attained by the patient. For example, the duration of this brief period is not long enough to result in the patient feeling the sensation of sinking into the mass of fluidizable material in the buttocks zone. Preferably the duration of the brief fluidization is on the order of between one half (½) second and one and one half (1½) seconds. If desired, the exact duration of the brief fluidization can be calculated by the microprocessor according to an algorithm. The time calculated by the algorithm preferably should vary depending upon the angle of inclination of the first surface and the height and weight of the patient.

More detailed description of components for practicing the methods of the present invention now will be described, beginning with FIG. 1 and frame 32, which can be provided with a plurality of rolling casters 34 for facilitating movement of patient support system 30. The diameter of the rotating member of each caster 34 preferably is a minimum of seven inches, and each caster 34 is preferably spring-loaded. Frame 32 preferably is constructed of rigid material such as tubular or angled metal capable of supporting the weight of the components carried thereon.

Each sack 36 preferably is ten and one-half inches in height measured above articulatable member 116 and about thirty-three and one half inches long measured in a direction transversely across member 116 shown in FIG. 10 for example. The thickness of each sack 36 is approximately four and one-half inches. A continuous retaining panel 38 preferably is attached to and surrounds sacks 36 to retain same together in an orderly fashion. Any conventional means of attachment such as snaps or zippers can be used to connect retaining panel 38 to sacks 36. As illustrated in FIG. 11 for example, elevation of member 116 from the horizontal position deforms the two sacks closest to the articulation joint 118 to accommodate the change in position of member 116.

Figure 13:
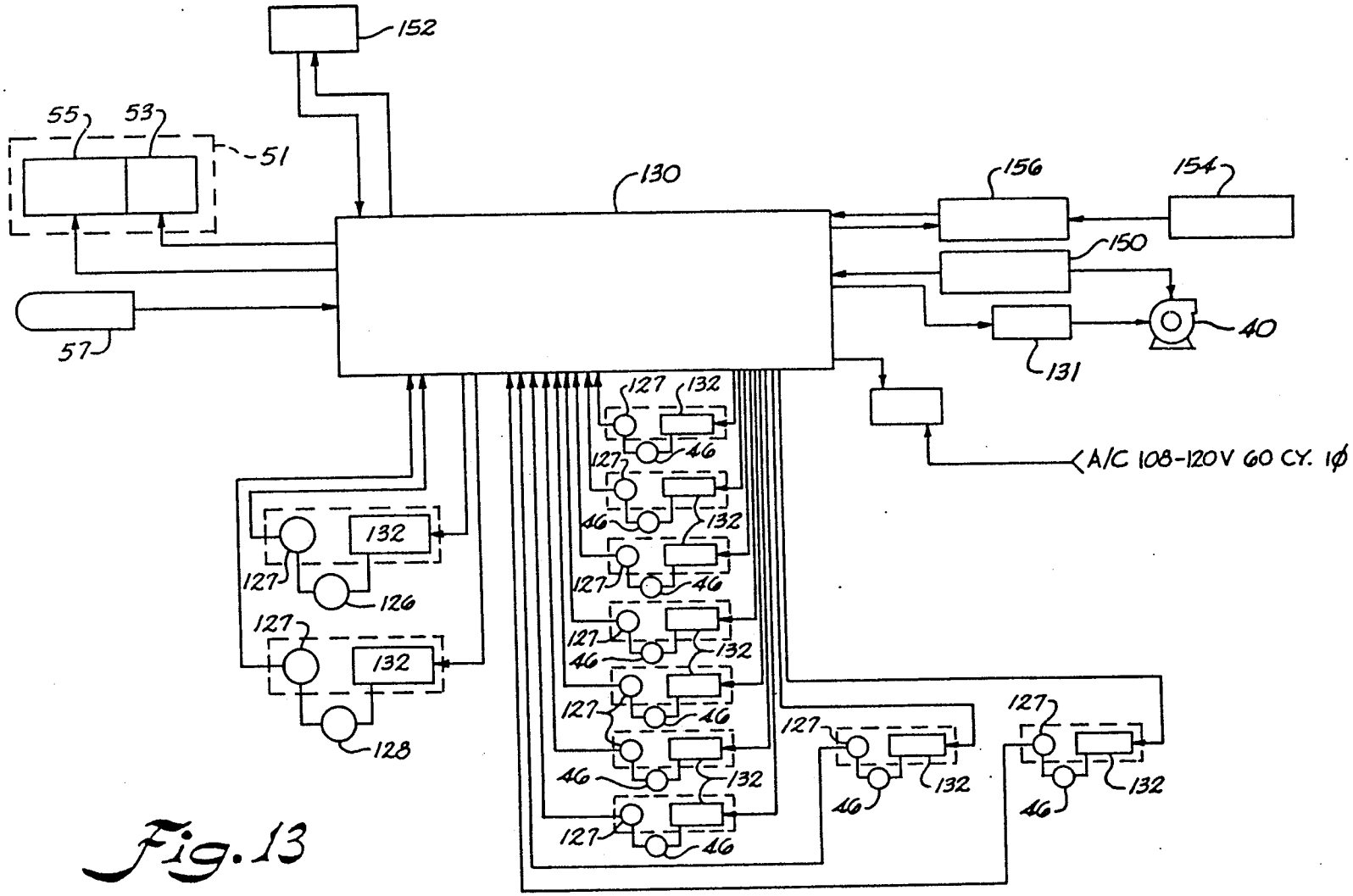
FIG. 13 illustrates a schematic diagram of components for practicing the present invention.

Means are provided for maintaining a preselected pressure in each inflatable sack 36. As embodied herein and shown schematically in FIG. 15 for example, the means for maintaining a preselected pressure in each inflatable sack includes a blower 40, a blower manifold 42, an air sack manifold 44, a plurality of pressure control valves 46, and a plurality of air impermeable tubes 48. Tubes 48 connect blower manifold 42 to blower 40 and to air sack manifold 44, and connect pressure valves 46 to air sack supply manifold 44 and to sacks 36. As shown in FIG. 13 for example, each pressure control valve 46 preferably includes a pressure transducer 127 which monitors the pressure at the outlet of valve 46. Each valve 46 further preferably includes an electric motor 132 to regulate the flow permitted to pass through valve 46 and accordingly the pressure being sensed by transducer 127.

As embodied herein and shown schematically in FIG. 13 for example, the means for maintaining a preselected pressure in each inflatable sack further includes a microprocessor 130. Microprocessor 130 preferably controls blower 40 via a blower control board 131 and receives signals from a pressure sensor 150 which monitors the pressure at the outlet side of blower 40. This determines the basic overall pressure level being supplied by blower 40. Furthermore, each pressure transducer 127 sends a signal to microprocessor 130 indicative of the pressure at the outlet of valve 46. Microprocessor 130 compares this signal to a signal stored in its memory. The stored signal corresponds to a preset pressure for that particular valve 46. Depending upon the results of the comparison, microprocessor 130 controls motor 132 to open or close valve 46 until the comparison indicates that the preset pressure has been attained. As shown in FIG. 13 for example, the preset pressure for each valve can be stored in the memory of microprocessor 130 via a key pad 154 and a control panel 156.

Means are provided for supporting the fluidizable medium and for permitting the diffusion of air through the fluidizable medium. Preferably, the supporting and diffusing means is carried by the frame. As embodied herein and shown in FIGS. 2*a*, 2*b*, 2*c*, 3*a*, 3*b*, 3*c*, 4, 6, 7, 8, 9, 10, 12*a*, 12*b*, and 12*c*, the means for supporting the fluidizable medium and for permitting the diffusion of air therethrough preferably includes a diffuser board 52, which preferably is formed of particle board or other air-permeable material which also happens to be impermeable to the passage of particles 50 therethrough. Diffuser board 52 is carried by frame 32. In a preferred embodiment, a perforated metal plate 54 is provided beneath diffuser board 52 to support and reinforce same. As shown in FIG. 10 for example, perforated plate 54 includes a plurality of holes 56 extending through plate 54 to allow for passage of air therethrough. Perforated plate 54 is also carried by frame 32 and preferably is fabricated of a sturdy but light weight metal such as aluminum or light gauge steel.

Means are provided for defining at least one air plenum beneath the supporting and diffusing means. The air plenum defining means is carried by the frame and has a predetermined section through which air is permeable. As embodied herein and shown in FIGS. 2*a*, 2*b*, 2*c*, 3*a*, 3*b*, 4, 6, and 10, the air plenum defining means preferably includes diffuser board 52 and a tank indicated generally in FIG. 10 for example by the designating numeral 58. Diffuser board 52 preferably covers a bottom 60 of tank 58 to form the upper member defining an air plenum 97 therebetween and comprises the predetermined section of the plenum defining means through which air is permeable.

Tank 58 has a bottom 60, a pair of opposite sidewalls 61, 62, and a closed end wall 64. Tank sidewalls 61, 62 and tank end wall 64 extend substantially in a direction normal to tank bottom 60. Sidewalls 61, 62 and end wall 64 preferably are integral and form a continuous wall disposed generally vertically relative to a horizontally disposed tank bottom 60. Tank 58 has an open top and can be open at one end thereof as in FIGS. 1 and 10 for example. Tank 58 can be formed of metal and preferably is formed of fiberglass or heat resistant plastic to reduce the overall weight of the dual mode patient support system. As shown in FIGS. 2*b* and 10 for example, tank 58 has at least one opening 59 through tank bottom 60 through which gas can be supplied to tank 58 and each air plenum. In a multi-plenum embodiment such as shown in FIG. 10, tank bottom 60 is provided with an opening for each plenum.

Figure 15:
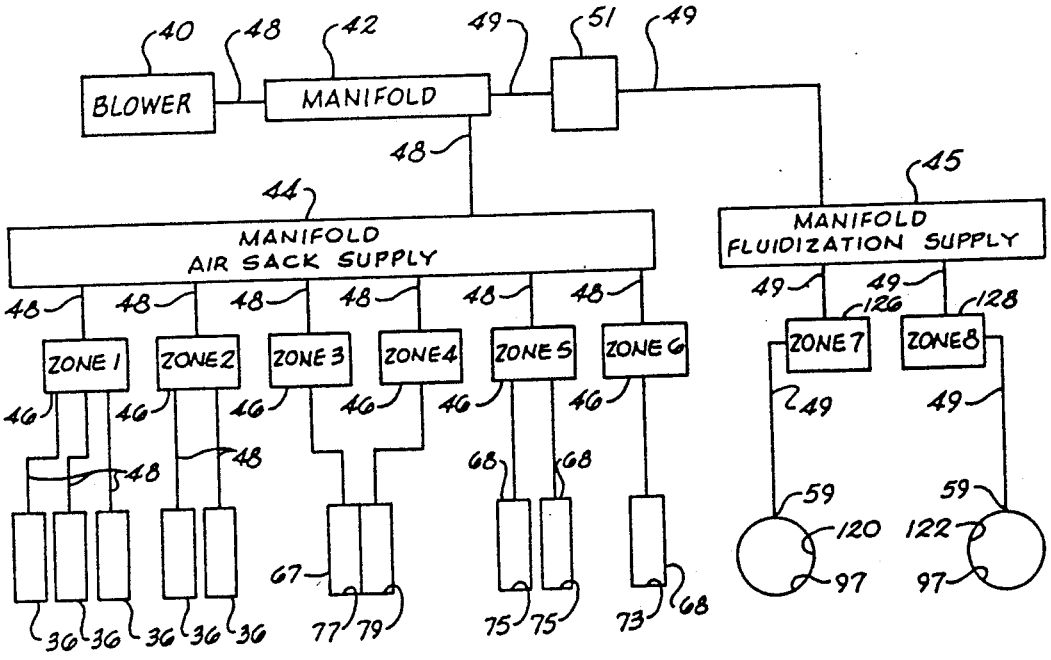
FIG. 15 illustrates a schematic diagram of components for practicing the present invention.

In a preferred embodiment of the plenum illustrated in FIGS. 10, 13, and 15 for example, the plenum 97 formed between tank bottom 60 and diffuser board 52 is divided into at least two separate plenum chambers 120, 122. This arrangement enables air to be supplied to one chamber at a different pressure than air is supplied to the other chamber or chambers. As shown in FIG. 10 for example, plenum chamber 120 is separated from plenum chamber 122 by an air impermeable divider 124. Preferably, at least one plenum chamber 120 is disposed to support the buttocks of the patient, and the second plenum chamber 122 is disposed to support the legs and feet of the patient. Preferably, the superficial flow rate and the pressure of the air supplied by blower 40 to the buttocks plenum chamber 120 can be regulated so as to be higher than that supplied to plenum chamber 122 for the legs and feet.

As embodied herein and shown in FIG. 10 for example, diffuser board 52 defines a first tier 41 and a second tier 43. First tier 42 defines the section of diffuser board 52 forming buttocks plenum chamber 120 and is disposed closer to tank bottom 60 than second tier 43, which defines the section of diffuser board 52 forming plenum chamber 122, and which is disposed to fluidize the material 50 supporting the legs and feet of the patient. Thus, a deeper mass of fluidizable material 50 is supported by first tier 41 of diffuser board 52 over buttocks plenum chamber 120 than is supported by second tier 43 of diffuser board 52 over leg and foot plenum chamber 122. In other words, the height of fluidizable material 50 is larger above first tier 41 of diffuser board 52 at buttocks plenum chamber 120 than above second tier 43 of diffuser board 52 at leg and foot plenum chamber 122.

A three inch differential in the height of the fluidizable material constitutes a very significant reduction in the weight of the patient support system. Typical overall dimensions for the patient support system are thirty-six inches in width and ninety inches in length. The typical width of the mass of fluidizable material is twenty-four to twenty-six inches, and the length of same is on the order of fifty-one inches. At a uniform depth of nine inches, these dimensions define a substantial volume of fluidizable material. In the embodiment of the present invention shown in FIG. 10 for example, the mass of fluidizable material supporting the patient's buttocks typically measures eighteen inches long in the direction parallel to the length of the patient support system, and the leg and foot zone is typically thirty-three inches long. The height of fluidizable material above buttocks plenum chamber 120 is nine inches, and the height above the leg and foot chamber 122 is six inches. Accordingly, two-tiered plenum embodiments such as shown in FIG. 10 result in the reduction of a volume of fluidizable material measuring eighteen inches by twenty-six inches by three inches. If the fluidizable material is formed of glass microspheres, this reduces the weight of the patient support system by about 150 pounds. Moreover, this reduction in the volume of fluidizable material permits use of a smaller blower, which weighs less and thus further reduces the overall weight of the system. Furthermore, a smaller blower lowers the power requirements for operating the system.

Means are provided for supplying air to fluidize the fluidizable medium. The fluidizing means can include the plenum and the air supplying means communicates therewith. As embodied herein and shown schematically in FIG. 15 for example, the means for supplying air to fluidize the fluidizable medium preferably includes blower 40, blower manifold 42, a fluidization supply manifold 45, one or more flow control valves 126, 128, and a plurality of flexible air conduits 48, 49. Air travels from blower 40 to plenum 97 via blower manifold 42, tubes 48, a heat exchange device 51, tubes 49, a fluidization supply manifold 45, control valves 126 or 128, and opening 59 through tank bottom 60. Blower 40 preferably is capable of supplying forty cubic feet of standard air per minute to the plenum at a pressure of up to twenty-three inches of water, while simultaneously supplying air to air sacks 36 and any other components of the system which are inflatable or require air flow. As noted above, microprocessor 130 also controls blower 40 via a blower control board 131 and receives signals from a pressure sensor 150 which monitors the pressure at the outlet side of blower 40.

The fluidization of the mass of fluidizable material 50 preferably can be operated at different modes of fluidization. In the continuous mode of operation, air is continuously supplied to flow through at least one plenum chamber. There are essentially four continuous modes of operation for fluidization. The zero mode of fluidization embodies the condition when the amount of air passing through the mass of fluidizable material is insufficient to fluidize same. This occurs when the superficial velocity of air through the flow area presented by the fluidizable material is on the order of 0.01 feet per second. At the minimum mode of fluidization, sufficient air is passing through the fluidizable material 50 to render same fluidized and thus reduce the shear forces to essentially zero. At the minimum mode of fluidization the superficial velocity of the air passing through the fluidizable material is on the order of 0.04 feet per second. The maximum mode of fluidization is that which renders the fluidization turbulent and occurs at about a superficial flow velocity of 0.07 feet per second. Accordingly, the intermediate mode of fluidization occurs between the minimum mode of fluidization and the maximum mode of fluidization and generally begins at a superficial velocity of about 0.05 feet per second. In yet another mode of operation, the intermittent mode of operation, the air flow is turned off for an interval of time and then turned on for an interval of time. The repetition of this sequence constitutes the intermittent fluidization mode of operation.

Means are provided for independently supplying air to each plenum chamber at independently preselected air flow rates. As embodied herein and shown schematically in FIGS. 13 and 15 for example, the means for separately supplying air to each plenum chamber at independently preselected air flow rates includes a flow control valve 126 for regulating the supply of air to plenum chamber 120 and a flow control valve 128 for regulating the supply of air to plenum chamber 122. The means for independently supplying air to each separate plenum chamber at a separate flow rate further includes a microprocessor 130 programmed to regulate flow control valve 126 and flow control valve 128. The means for supplying air to each separate plenum chamber at a separate flow rate further includes a flow sensing device such as an air velocity sensing device 127 disposed to measure the flow through each flow control valve 126, 128.

Means are provided for retaining the fluidizable medium generally above the supporting and diffusing means and thus above the air plenum. The retaining means is carried by the frame and serves to provide lateral support that prevents lateral spreading of the fluidizable material beyond a certain boundary, which boundary preferably is the perimeter of diffuser board 52. As embodied herein and shown in FIGS. 1, 2*a*, 2*b*, 2*c*, 2*d*, 3*a*, 3*b*, 4, 6, 7, 8, 9, 10, 11, 12*a*, 12*b*, and 12*c* for example, the means for retaining the fluidizable medium generally above the supporting and diffusing means preferably includes an elastic wall, which exists in a number of different embodiments. As shown in FIG. 1 for example, the elastic wall is indicated generally in the figures by the designating numeral 66. As shown in FIGS. 1, 2*a*, 2*b*, 10, and 14 for example, elastic wall 66 can comprise an inflatable U-shaped member 68. As shown in FIGS. 2*a*, 2*b*, and 10 for example, inflatable U-shaped member 68 preferably comprises a plurality of internal webs 70 which subdivide the interior space of member 68 into a plurality of compartments 72*a*, 72*b* and 72*c*. At least a single web 70 defines two compartments 72, and the lower compartments are the ones closer to diffuser board 52. In some embodiments, the upper compartments can be separately pressurizable from the lower ones. As shown in FIGS. 3*a*, 8, 9 and 14 for example, elastic wall 66 can include an inflatable interface sack 67 extending across the open end of tank 58 and providing the interface between the fluidizable material 50 and inflatable sacks 36. As shown in FIGS. 3*a*, 8, 9, and 14 for example, interface sack 67 preferably includes two compartments 77, 79 which are separated by web 70 and separately pressurizable. As shown in FIG. 14 for example, elastic wall 66 comprises interface sack 67 and U-shaped member 68. U-shaped member 68 comprises upper compartments 75 and lower compartment 73. Interface sack 67 is disposed across the open end of U-shaped member 68. By supplying air to each of compartments 73, 75, 77, and 79 via a separate pressure valve 46, the lower compartments 73, 79 can be maintained at a higher pressure than the upper compartments 75, 77. This facilitates enhancing the comfort of the patient coming into contact with upper compartments 75, 77, while providing more rigidity to lower compartments 73, 79, which bear more of the burden of retaining fluidizable material 50. The lower pressure renders upper compartments 75, 77 more deformable than the lower compartments and thereby facilitates patient ingress and egress to and from the fluidizable support. Interface sack 67 can be integrally formed with U-shaped member 68 by having common exterior wall panels. In other embodiments, the exterior wall panels of U-shaped member 68 and interface sack 67 can be joined in air-tight fashion. As shown in FIG. 14 for example, interface sack 67 is configured with the same exterior dimensions as inflatable sacks 36 and is largely indistinguishable from same when judged by outward appearances.

Figure 3A:
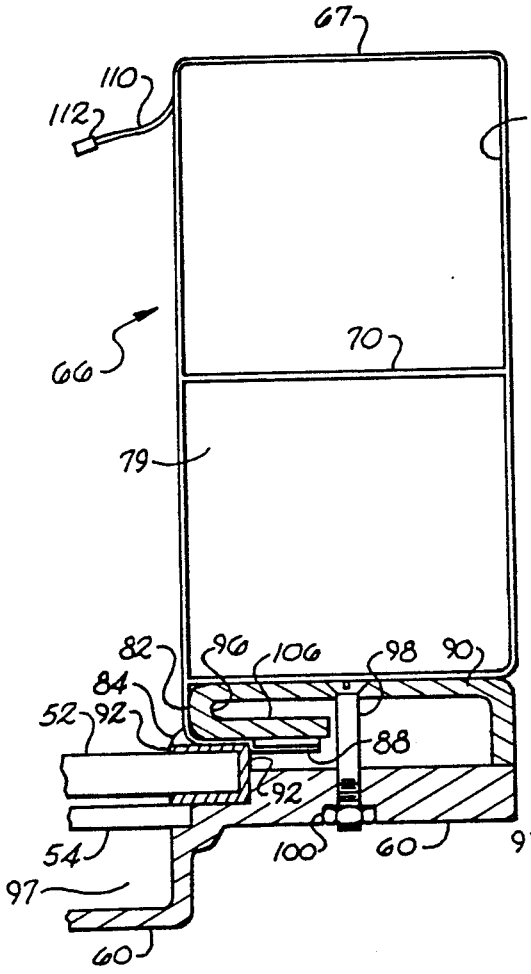
FIG. 3*a* illustrates a detailed cross-sectional view of components for practicing the present invention taken in a direction similar to the lines 3—3 of FIG. 1.
Figure 3B:
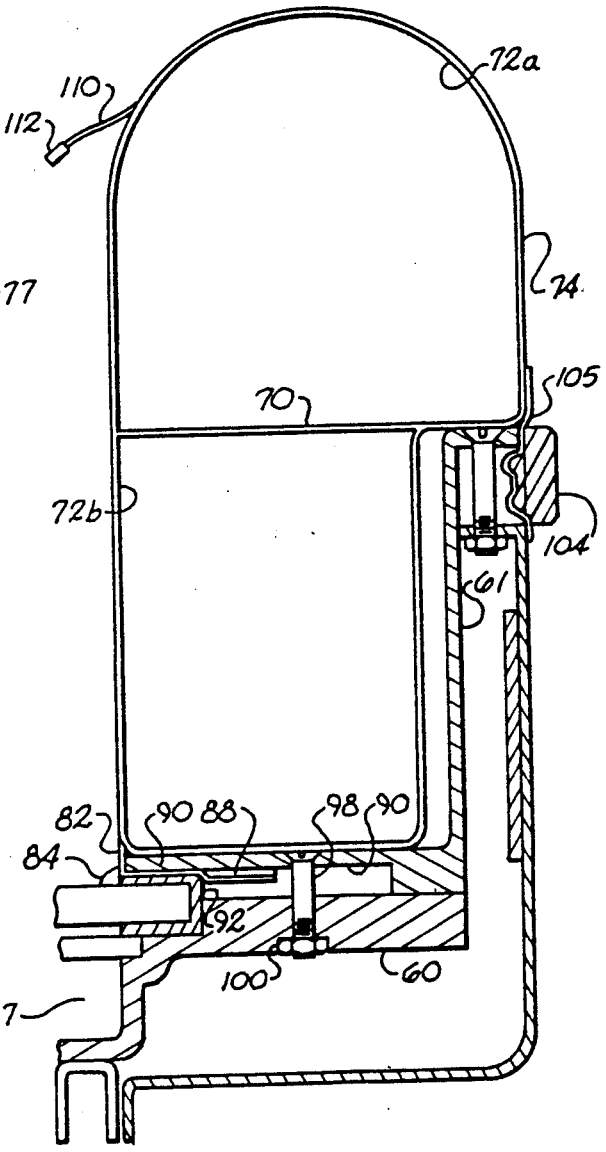
FIG. 3*b* illustrates a partial, detailed cross-sectional view of components for practicing the present invention taken in a direction similar to the lines 2—2 of FIG. 1.

In the embodiments of elastic wall 66 illustrated in FIGS. 2*a*, 2*b*, 3*b*, 4, 6, and 10 for example, the uppermost compartment 72*a* is larger than the lower compartments 72*b*, 72*c* and forms an overhanging portion 74 which extends over the free edge of sidewalls 61, 62 and end wall 64 of tank 58. As shown in FIG. 3*b* for example, an elastomeric fastener 104 retains a securing flap 105 by press fitting flap 104 into a receptacle therefor, and so secures the elastic wall to the sidewall of the tank. In an embodiment such as shown in FIG. 7 for example, all compartments 72 are similarly configured. As shown in FIG. 2*c* for example, an embodiment of an uppermost compartment 76 has a hemispherical shape and does not have an overhanging portion.

Figure 3C:
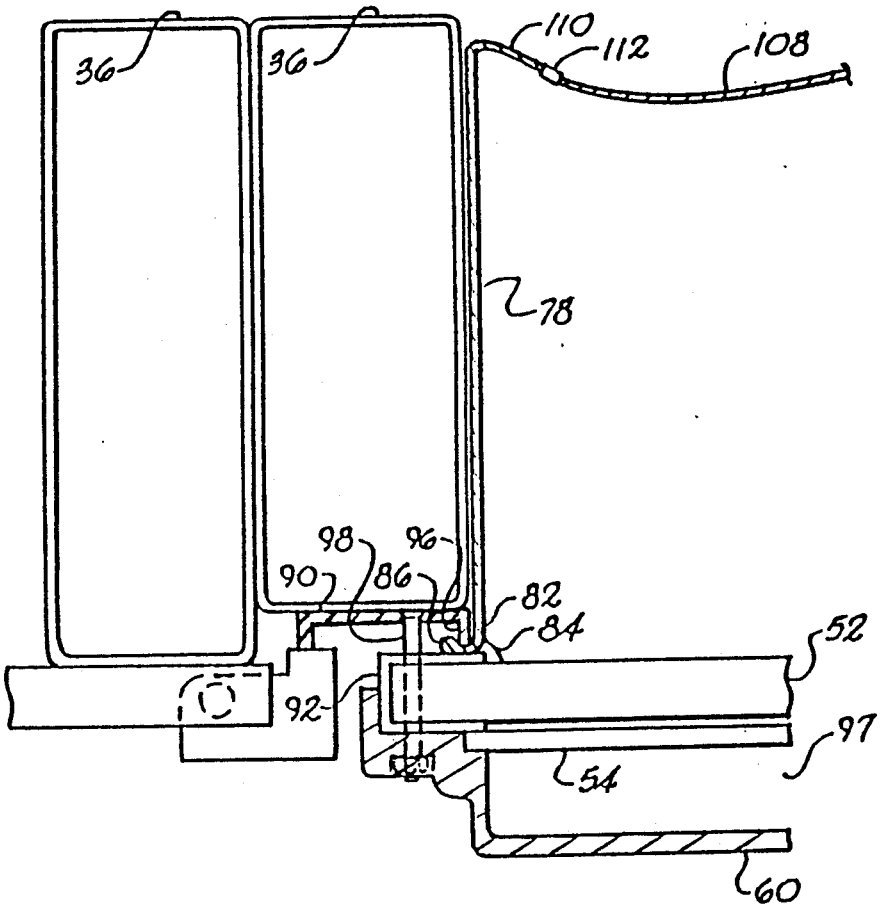
FIG. 3*c* illustrates a detailed cross-sectional view of components for practicing the present invention taken along the lines 3—3 of FIG. 1.

As shown in FIGS. 3*c*, 10, 12*a*, 12*b*, and 12*c*, one alternative embodiment of elastic wall 66 comprises a non-rigid panel 78 which is impermeable to the passage of both air and fluidizable material. Panel 78 preferably is formed of a fabric coated with polyurethane or the like. As shown in FIG. 3*c* for example, panel 78 rests against an inflatable sack 36, which together with the other inflatable sacks 36 provide sufficient rigidity to retain the fluidizable material generally above diffuser board 52.

Figure 6:
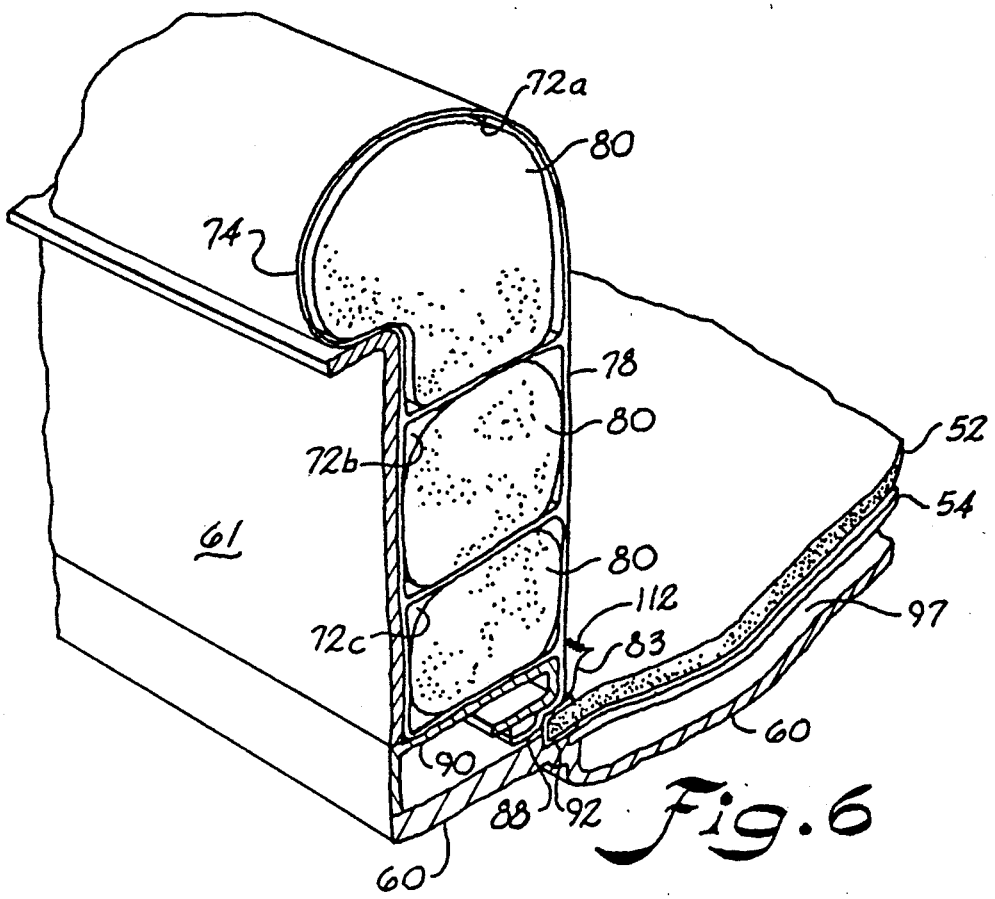
FIG. 6 illustrates a perspective, cut-away view of components for practicing the present invention taken along lines similar to lines 4—4 in FIG. 1, but without any fluidizable material.
Figure 7:
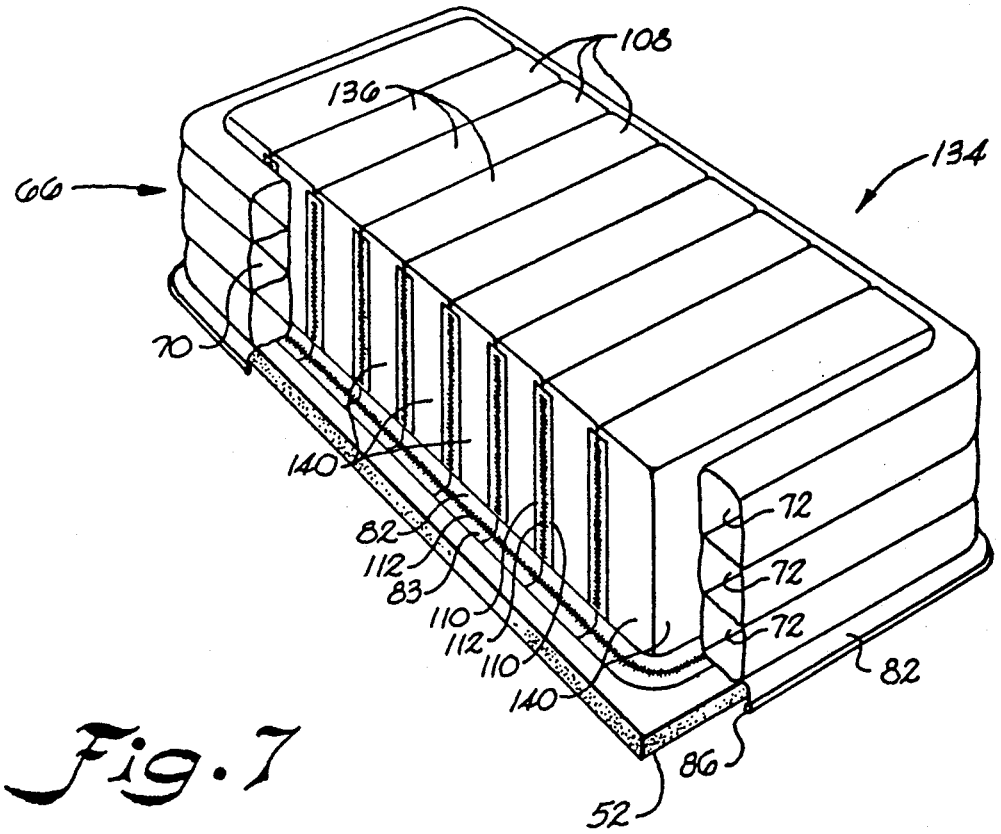
FIG. 7 illustrates a perspective, partially cut-away view of alternative embodiments of components for practicing the present invention.

As shown in FIG. 6 for example, an embodiment of elastic wall 66 can include a plurality of deformable inserts 80 disposed within and substantially filling each compartment formed by an embodiment of impermeable panel 78 which has been configured to completely envelope inserts 80. Each insert 80 preferably is formed of polyurethane foam or a polymeric deformable material. Moreover, some compartments can include an insert 80, while other compartments need not include an insert 80.

In an alternative embodiment of the present invention, the means for laterally retaining the fluidizable material over a predetermined air permeable section of the plenum defining means can include a rigid wall member such as walls 61, 62 and 64 of tank 58 described above.

Figure 12A:
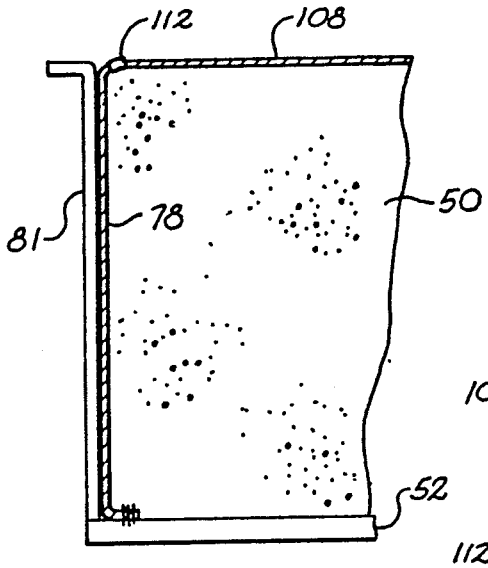
FIG. 12*a* illustrates a partial cross-sectional view of components for practicing the present invention in a fluidized state.
Figure 12B:
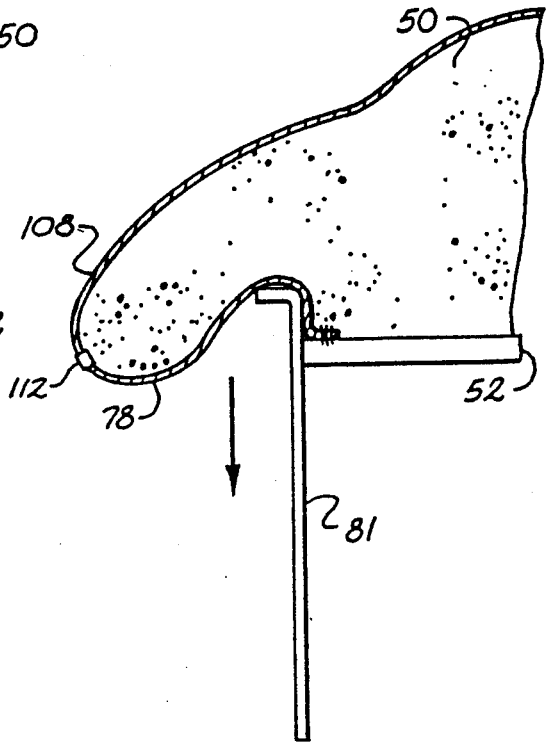
FIG. 12*b* illustrates a partial cross-sectional view of components for practicing the present invention in a defluidized state.
Figure 12C:
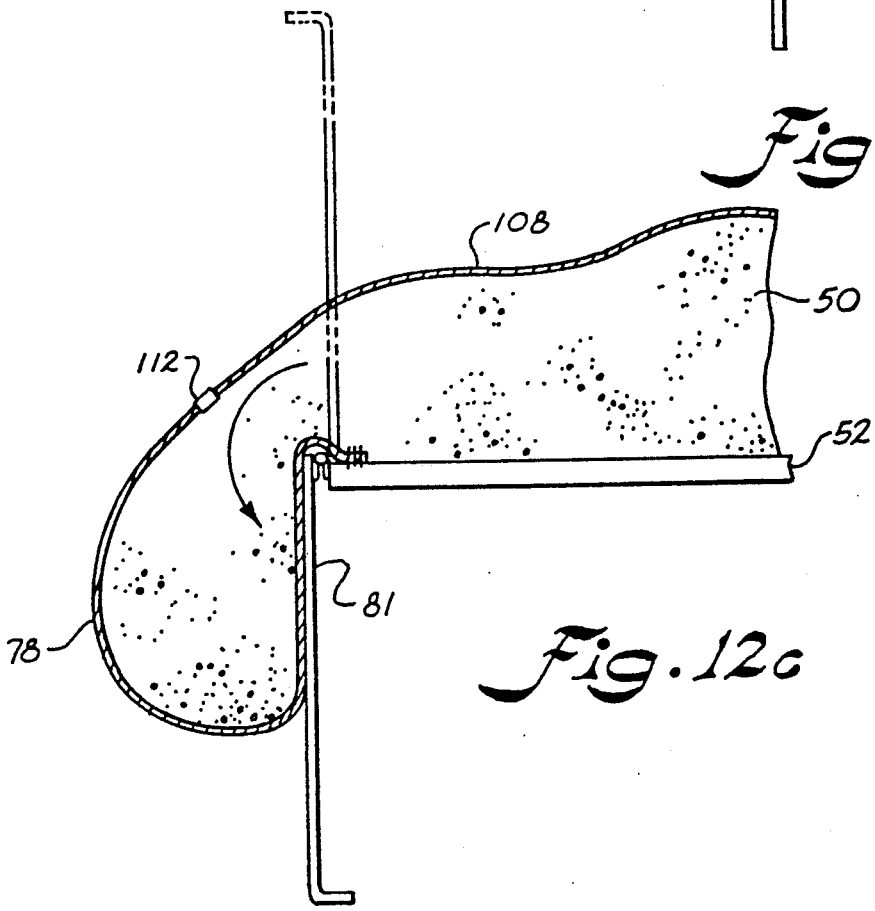
FIG. 12*c* illustrates a partial cross-sectional view of components for practicing the present invention in a defluidized state.

As shown in FIGS. 12*a*–12*c* for example, the means for retaining the fluidizable material over a predetermined air permeable section of the plenum defining means can include a rigid tank sidewall 81, an elastic wall embodiment such as a flexible impermeable panel 78, and an air permeable sheet 108 connected to air impermeable panel 78. Though not shown in FIG. 12, panel 78 can be disposed without interruption around the sides and closed end of tank 58, and an interface sack 67 can be used to retain the fluidizable material at the open end of tank 58. In other embodiments, panel 78 completely surrounds the fluidizable material.

Figure 5:
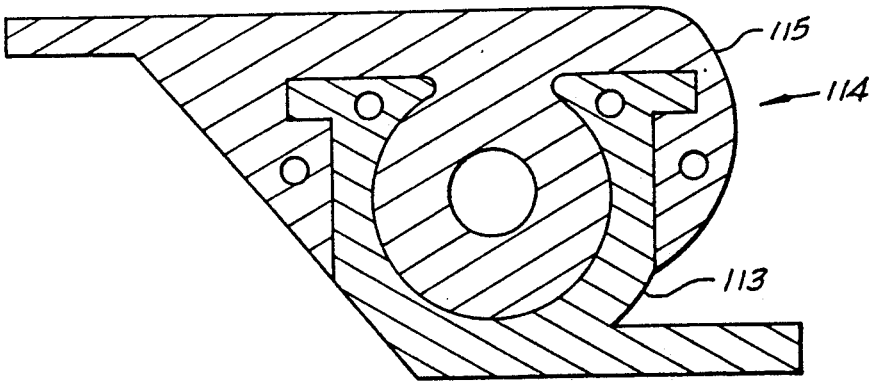
FIG. 5 illustrates a cross-sectional view of components for practicing the present invention.

In order to facilitate patient ingress to and egress from the patient support system, at least a section of rigid sidewall 81 is selectively collapsible, either via a grooved track mechanism as illustrated schematically in FIG. 12*b* or by a bottom hinged mechanism illustrated schematically in FIG. 12*c*. Air permeable sheet 108 is impermeable to passage of fluidizable material therethrough and is joined at its periphery to panel 78 by an air tight means of attachment such as an air tight zipper 112 or an elastomeric attachment 114 (FIG. 5).

Figure 4:
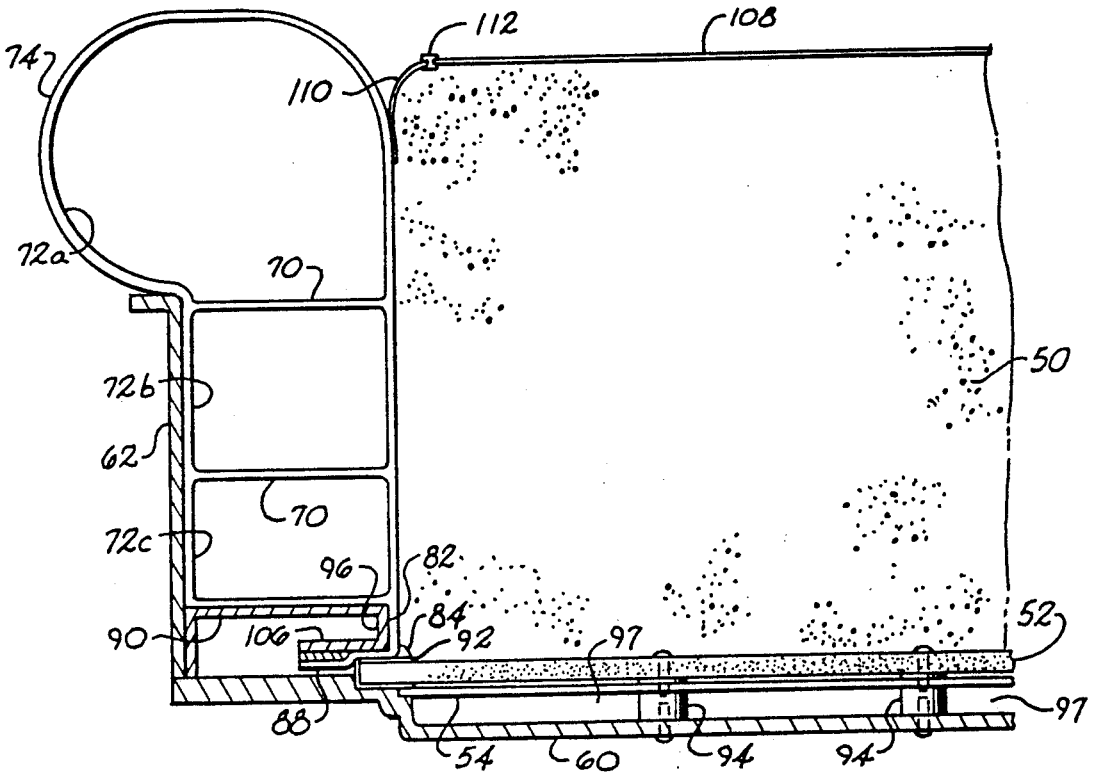
FIG. 4 illustrates a partial, detailed cross-sectional view of components for practicing the present invention in a fluidized state taken along the lines 4—4 of FIG. 1.

The manner by which the retaining means confines the fluidizable medium generally above the supporting and diffusing means is most easily explained by reference to FIGS. 3 and 4 for example. The elastic wall has an attachment flap 82. The free end of attachment flap 82 has an anchoring member, which can for example be a cord 86 in some embodiments (FIGS. 3*c*, and 7) or a hook and loop type fastener strip 88 in others (FIGS. 3*a*, 3*b*, 4, and 6). As shown in FIGS. 3*a*, 3*b*, 4, and 6 for example, a rigid clamping channel 90 rests atop tank bottom 60. The free edge of diffuser board 52 is surrounded by a silicone rubber sleeve 92 to form an air-impermeable fitting around the entire free edge of diffuser board 52. In a preferred embodiment, a plurality of support posts 94 (FIG. 4) separates diffuser board 52 and perforated metal plate 54 from tank bottom 60 and support diffuser board 52 and plate 54 above tank bottom 60. Attachment flap 82 extends between the outer surface of an inner leg 96 of clamping channel 90 and sleeve 92. Then attachment flap 82 extends around inner leg 96 so that the anchoring member (86 or 88) extends beyond the inner surface of inner leg 96 as shown in FIGS. 3*c* and 4 for example. Clamping channel 90 is secured to tank bottom 60 via a clamping bolt 98 and a nut 100. Thus, attachment flap 82 is secured in air tight fashion between tank bottom 60 and the free end of inner leg 96 of clamping channel 90. A bead 84 of an air impermeable sealant can be applied between sleeve 92 of diffuser board 52 and elastic wall 66. Bead 84 preferably is formed of any room temperature vulcanizing compound (RTV), such as a silicone rubber composition which hardens after exposure to air at room temperature. In this way, air entering a plenum 97 formed between diffuser board 52 and tank bottom 60 cannot escape past the free edge of diffuser board 52 or inner leg 96 of clamping channel 90. Furthermore, elastic wall 66 is air impermeable. Thus, air entering plenum 97 under pressure from blower 40 must pass up through diffuser board 52 into the fluidizable material supported thereabove.

FIG. 3*a* illustrates one embodiment of interface sack 67 of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge of diffuser board 52. A clamping channel 90 secures and seals attachment flap 82 against sleeve 92 in an air-tight fashion and has an anchoring flange 106. In this embodiment, the anchoring member comprises a hook and loop strip 88 which attaches to a mating hook and loop strip, such as a VELCRO strip, secured to the underside of anchoring flange 106 of clamping channel 90. Clamping bolts 98 are used to secure clamping channel 90 against tank bottom 60 and diffuser board 52. Moreover, clamping channel 90 can be provided with openings (not shown) through which tubes (not shown) or other conduits for supplying gas to elastic wall 66 can be passed.

FIGS. 3*c* and 10 illustrate another preferred embodiment of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge thereof. A clamping member 90 secures and seals attachment flap 82 of panel 78 against sleeve 92 in an air-tight fashion and has an inner leg 96. As shown in FIG. 3*c* in this embodiment, the anchoring member comprises a cord 86 which rests against the inner surface of inner leg 96. Clamping channel 90 is secured to tank bottom 60 via a clamping bolt 98 and nut 100. Thus, attachment flap 82 is secured in air-tight fashion between inner leg 96 of clamping channel 90 and silicon sleeve 92. A bead 84 of RTV is applied between sleeve 92 and flexible panel 78. In this way, air entering a plenum 97 formed between diffuser board 52 and tank bottom 60 cannot escape pass the free edge of diffuser board 52 or inner leg 96 of clamping channel 90. Furthermore, air impermeable panel 78 forces air entering plenum 97 and passing through diffuser board 52 to pass through the fluidizable material before exiting through an air permeable sheet 108 connected to panel 78 via an air-tight zipper 112 for example.

As embodied herein and shown in FIGS. 1, 2, 3*c*, 4, 7, 8, 9, and 12 for example, a flexible cover sheet is formed by an air permeable sheet 108, which is connected to the retaining means so as to contain the fluidizable material and simultaneously permit the fluidizing air to escape. Air permeable sheet 108 is preferably formed of a fine mesh fabric that is impermeable to the passage of the fluidizable material therethrough. Air permeable sheet 108, the retaining means, and the diffuser board are connected to one another and thereby cooperate to provide means for containing the fluidizable medium and for permitting the diffusion of air therethrough.

Means are provided for detachably attaching the periphery of the air permeable cover sheet to the retaining means so as to prevent passage of the fluidizable material past this sheet attaching means. The sheet attaching means preferably prevents passage of particles therethrough having a narrowest dimension greater than 30 microns. The sheet attaching means is further preferably configured so as to be easily engagable and disengagable without great manual strength or dexterity. As embodied herein and shown in FIG. 12 for example, the sheet attaching means includes an attachment mechanism such as an airtight zipper 112. In an alternative embodiment shown in FIGS. 3, 4, and 10 for example, the means for attaching sheet 108 to the retaining means preferably includes a flexible attachment flap 110 connected to an attachment mechanism such as an air-tight zipper 112. Attachment flap 110 preferably is impermeable to the passage of air therethrough and to the passage of fluidizable material therethrough. An alternative embodiment of an attachment mechanism is generally designated by the numeral 114 illustrated in FIG. 5 for example, and comprises an elastomeric interlocking mechanism. Mechanism 114 includes two mating elastomeric members 113, 115, and both members join together to form an air-tight seal. The two elastomeric members are easily deformable to come apart and join together under the manipulation of human hands. The ease with which the embodiments of the sheet attaching means can be engaged and disengaged by hand greatly facilitates the removal of the fluidizable material whenever replacement is desireable. It also greatly facilitates replacement of air permeable sheet 108 whenever soiling of same requires that it be changed.

Means are provided for supplying air at a plurality of independently determinable pressures to separate pressure zones of the patient support system and at a plurality of independently determinable air flow rates to separate flow rate zones of the patient support system. In a preferred embodiment illustrated in FIGS. 14 and 15 for example, the various facilities of the patient support system requiring a supply of air are assigned a separate valve to facilitate effecting independent levels of pressurization and/or rates of air flow. These various facilities include air sacks 36, air plenum 97, air plenum chambers 120, 122, and interface sack 67 and the other inflatable components of elastic wall 66. Each valve segregates a separate zone, and thus air from blower 40 is provided to a plurality of separately controllable zones. Each separate zone is controlled by either a pressure control valve 46 or a flow control valve 126, 128. Each pressure control valve and flow control valve is controlled by microprocessor 130 such as shown in FIG. 13 for example. Each pressure control valve 46 and flow control valve 126, 128 has either a pressure sensing device which measures the pressure at the outlet of the valve or a flow sensing device which measures the flow through the valve. Each such measuring device sends a signal indicative of the measurement to microprocessor 130. As embodied herein, a transducer 127 provides a suitable sensing device. Each valve 46, 126, 128 further comprises an electrically operated motor 132 which opens and closes each valve. Microprocessor 130 controls each motor 132 of each valve, and a preselected pressure or flow for each valve can be selected and stored in the memory of microprocessor 130 via key pad 154 and control panel 156. Microprocessor 130 is programmed to control motor 132 so as to regulate the pressure or flow through the valve in accordance with the preselected value of pressure or flow stored in the memory of microprocessor 130. Similarly, microprocessor 130 can be programmed to change the preselected pressure or flow through one or more of valves 46, 126, 128.

As shown in FIG. 15, for example, individual sacks or groups of sacks can be associated with a single zone which is supplied by a single pressure control valve 46. Accordingly, all of the sacks controlled by a single pressure control valve 46 can be maintained at the same pressure by the microprocessor, which uses the valve's transducer 127 to monitor the pressure at the valve's outlet.

In one embodiment illustrated in FIGS. 14 and 15 for example, eight different zones are each independently maintainable at a different pressure and/or flow rate of air by blower 40. Zone 1 includes a plurality of inflatable sacks 36, which preferably lack any air escape holes. Occasionally, a small amount of air will leak from the seams of sacks 36. However, such leakage, if any, is essentially inconsequential. Blower 40 provides sufficient air to sacks 36 in zone 1 to maintain them at a pressure between one and twenty inches of water. Zone 2 includes a plurality of air sacks 36, which preferably lack air escape holes. Blower 40 preferably supplies air to sacks 36 in zone 2 at a pressure that can vary between zero and twenty inches of water. Zone 3 includes upper compartment 77 of interface sack 67, and blower 40 preferably supplies air thereto at a pressure that can be varied between zero and twenty inches of water. Since no air escape holes are provided in interface sack 67, the flow rate of air provided to compartment 77 is essentially zero, ignoring inconsequential leakage at the seams of the sacks. Zone 4 includes lower compartment 79 of interface sack 67, and blower 40 supplies air thereto at a pressure that preferably can be varied between zero and twenty inches of water, and the flow rate of air is essentially zero. Zone 5 includes upper compartments 75 of U-shaped member 68 of elastic wall 66. Compartments 75 lack any air escape holes, and blower 40 supplies air to compartments 75 at a pressure that preferably can be varied between zero and twenty inches of water and a flow rate of essentially zero cubic feet per minute. Zone 6 includes lower compartment 73 of U-shaped member 68, and compartment 73 similarly lacks any air escape holes. Blower 40 supplies air to compartment 73 in pressure zone 6 at a pressure that preferably can be varied between zero and twenty inches of water, and the air flow rate is essentially nil. (In an alternative preferred embodiment, there are no compartments 75, and zones 5 and 6 are consolidated into a single zone. This reduces the number of pressure control valves by one.) Zone 7 is a flow rate zone and includes buttocks plenum chamber 120 of plenum 97 illustrated in FIG. 10 for example. Similarly, zone 8 includes plenum chamber 122, which preferably provides air to fluidize the mass of fluidizable material 50 disposed to support the legs and feet of the patient. During fluidization of the mass of fluidizable material, blower 40 supplies air in zone 7 to buttocks plenum chamber 120 at a pressure between twelve and twenty-two inches of water and a flow rate between five and twelve cubic feet per minute. Similarly, blower 40 supplies air in zone 8 to legs and feet plenum chamber 122 during fluidization of the mass of fluidizable material thereabove at a pressure of between six and eighteen inches of water and a flow rate of between five and twenty-eight cubic feet per minute.

Means also are provided for intermittently supplying air flow to at least one of plenum chambers 120, 122. In this way, the mass of fluidizable material disposed above at least one of plenum chambers 120, 122 and preferably one or both plenum chambers 120, 122 can be fluidized intermittently. As embodied herein and shown in FIGS. 13 and 15 for example, the means for intermittently supplying air flow to at least one plenum chamber preferably includes a microprocessor 130 controlling actuation of the flow control valve 126 or 128 which regulates air flow to the plenum chamber which is selected for an intermittent mode of air flow supply. Each plenum chamber 120, 122 is supplied with air through respective flow control valve 126, 128. The amount of air flow permitted to pass through each flow control valve 126, 128 is controlled by microprocessor 130 according to a preprogrammed set of instructions stored in the memory of microprocessor 130.

For example, during a given interval of time between one and five minutes, the appropriate flow control valve 126 or 128 is closed to prevent any air flow from reaching the respective plenum chamber 120 or 122. In other words, the fluidizable material supported above such plenum chamber is maintained in an unfluidized state. After the passage of this predetermined interval, which can be preset via a control panel which inputs the desired interval into the appropriate set of instructions stored in microprocessor 130, microprocessor 130 opens the appropriate flow control valve to permit at least a minimum level of fluidization of material 50 supported above the corresponding plenum chamber and maintains this minimum fluidization for about one-half to ten seconds for example. One or both or neither plenum chamber can be operated according to the intermittent mode of fluidization, as desired by selecting this mode on the control panel which sends the appropriate signal to microprocessor 130.

If it is desired to permit egress from or ingress to the patient support system embodiment shown in FIG. 14 for example, the pressure control valve supplying air to compartments 75 can be controlled by microprocessor 130 through suitable controls on key pad 154 so as to reduce the pressure within compartments 75. The reduced pressure renders them soft enough to permit the patient to slide over them relatively easily. At the same time, the pressure control valve regulating the pressure in compartment 73 of elastic wall 66 can be maintained high enough to provide sufficient rigidity to the remainder of the elastic wall so as to prevent the fluidizable material from unduly deforming elastic wall 66 while the patient is entering or exiting the fluidizable support. Similarly, upper compartment 77 and lower compartment 79 of interface sack 67 can be maintained at different pressures if each is supplied by a different pressure control valve 46. In this way, the lowermost compartment 79 can be maintained at a higher pressure than upper compartment 77 to facilitate retaining the mass of fluidizable material. Maintaining a lower pressure in upper compartment 77 permits it to be compressed for the comfort of the patient, or when the articulatable member is raised to form an angle of inclination with the horizontal as shown in FIG. 11 for example. The pressure in compartment 77 can be lowered automatically by suitable programming of the microprocessor to control the pressure in compartment 77 during articulation of member 116.

Each control valve 46 can be operated in a so-called dump mode which permits instantaneous opening of the valve so as to permit instantaneous depressurization through the valve. Thus, pressure control valves 46 are capable of operating as would a solenoid valve insofar as depressurization is concerned. This mode of valve operation permits instantaneous deflation of inflatable sacks 36 for example. Such deflation is desirable to permit a cardiopulmonary resuscitation (CPR) procedure to be performed on a patient. Such procedure requires a rigid surface rather than the compressible surface provided by inflatable sacks 36. Key pad 154 of control panel 156 signals microprocessor to trigger the pressure control valves 46 to the dump mode.

As shown schematically in FIG. 15 for example, a heat exchange device 51 also can be provided to regulate the temperature of the air supplied to fluidize the mass of material 50. As shown schematically in FIG. 13 for example, microprocessor 130 also controls heat exchange device 51, which includes a heater 53 and a heat exchanger 55. A temperature probe 57 can be provided and disposed so as to record the temperature inside fluidizable material 50 and provide a signal to microprocessor 130. Microprocessor 130 then activates heater 53 to regulate the temperature of the mass of fluidizable material according to predetermined temperature range parameters stored in the memory of microprocessor 130. Microprocessor 130 also can display the temperature on control panel 156 for example.

Alternative means can provide the second surface formed by a mass of fluidizable material. As embodied herein and shown in FIGS. 7–9 for example, the alternative means for providing a second surface formed by a mass of fluidizable material preferably comprises at least one fluidizable cell 134, and preferably a plurality of cells 134. Each fluidizable cell 134 has an upper wall 136 that can cover an alternative embodiment of the second surface of fluidizable material, a lower wall 138, and a sidewall 140 extending between and connecting the upper wall and the lower wall. Each cell 134 contains a mass of fluidizable material 50 therein, and walls 136, 138, and 140 prevent passage of the fluidizable material therethrough. Each upper wall 136 and each lower wall 138 of each fluidizable cell 134 is permeable to the passage of air therethrough. Each sidewall 140 of each fluidizable cell 134 preferably is impermeable to passage of air therethrough.

Figure 8:
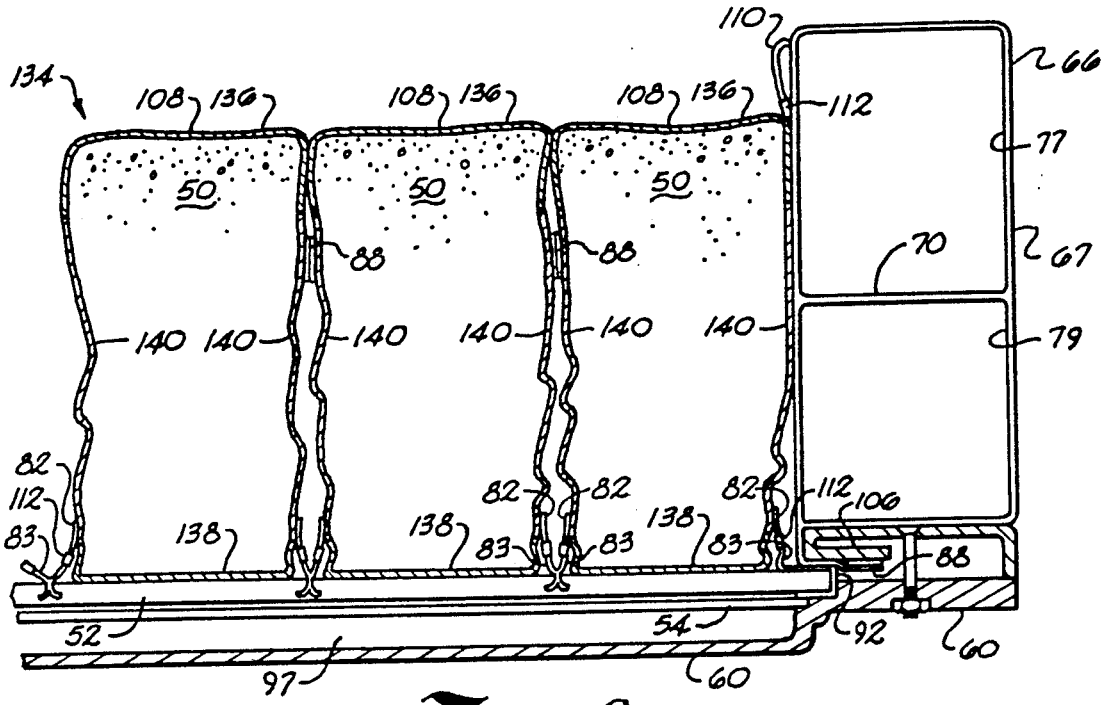
FIG. 8 illustrates a cross-sectional view of components for practicing the present invention in a defluidized state.
Figure 9:
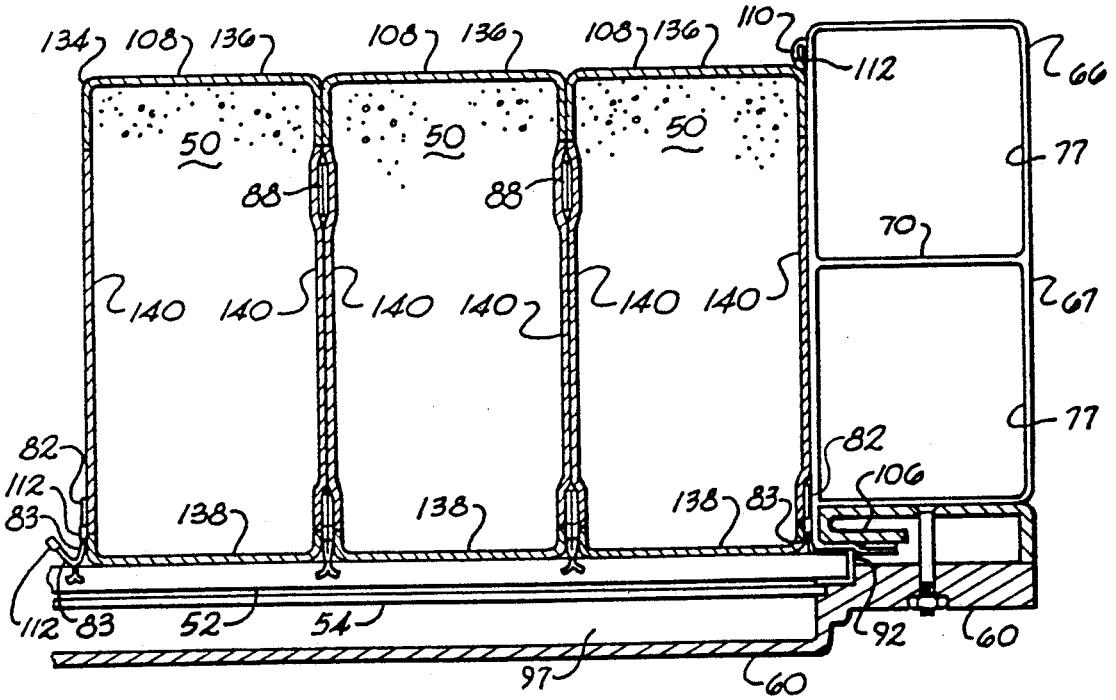
FIG. 9 illustrates a cross-sectional view of components for practicing the present invention in a fluidized state.

The upper walls are connected in air impermeable fashion to the retaining means surrounding the cells. An air impermeable seal is formed between the elastic wall and at least a portion of the periphery of each upper wall 136 of each fluidizable cell 134. This is preferably accomplished as shown in FIGS. 8 and 9 for example, in which each fluidizable cell 134 is connected to the retaining means such as elastic walls 66 via an attachment flap 110 and an attachment mechanism such as air-tight zipper 112. Each upper wall 136 of each fluidizable cell preferably is formed as a disengagable section of an air permeable cover sheet 108. Preferably, the remaining portion of the periphery of each upper wall 136 is connected to the remaining portion of the periphery of each upper wall of each adjacent fluidizable cell 134 via respective attachment flaps 110 and zippers 112 for example. In an alternative embodiment shown in FIGS. 8 and 9 for example, hook and loop type strips 88 are provided to connect adjacent sidewalls 140 of adjacent cells 134. These strips 88 preferably are located near the interface between upper wall 136 and sidewall 140 of each cell 134. In this way all of the upper walls 136 of cells 134 are connected to and/or disposed alongside one another.

In another alternative embodiment shown in FIG. 7 for example, the adjacent cells are connected to one another at the vertical edges of the narrow ends of sidewalls 140 via attachment flaps 110 and an attachment mechanism such as zippers 112. Since all of the cells are connected to one another, the upper walls 136 of cells 134 are combined to form an air permeable surface which functions like air permeable sheet 108 to prevent passage of the fluidizable material therethrough while at the same time permitting passage of air therethrough in order to allow air to pass through fluidizable material 50 and fluidize same.

Means are provided for connecting the fluidizable cells to diffuser board 52. As embodied herein and shown in FIGS. 7, 8, and 9 for example, the means for connecting the fluidizable cells to diffuser board 52 preferably includes an attachment flap 82, an anchoring flap 83, and a means for securing the attachment flap to the anchoring flap without permitting passage of air thereby. Preferably, the lower portion of sidewall 140 near lower wall 138 of each fluidizable cell has an attachment flap 82. One end of an anchoring flap 83 is secured to diffuser board 52. Where there are a plurality of fluidizable cells, the attachment flap of the fluidizable cell closest to elastic wall 66 attaches via an embodiment of the connecting means to the anchoring flap which extends from the edge of diffuser board 52. In an alternative embodiment shown in FIG. 6 for example, anchoring flap 83 extends from the base of the elastic wall instead of from the diffuser board. In both cases, the flow of air through the diffuser board is constrained to pass through lower walls 138 of cells 134 and cannot leak between cells 134 and elastic wall 66 for example.

As embodied herein and shown in FIGS. 8 and 9 for example, the means for attaching the attachment flap to the anchoring flap preferably comprises an air impermeable zipper 112. An alternative embodiment of the attaching means includes an airtight elastomeric attachment mechanism 114 such as shown in FIG. 5 for example. In either case, the connecting means is selectively engagable and disengagable to permit removal of each fluidizable cell and substitution of a replacement fluidizable cell for the removed cell.

As shown in FIGS. 7, 8, and 9 for example, a plurality of fluidizable cells can be disposed transversely across diffuser board 52 and connected thereto via attachment flaps 82 located on sidewall 140 near lower wall 138 of each cell 134 and anchoring flaps 83 disposed in spaced relation on diffuser board 52.

Means are provided for containing the fluidizable medium. One embodiment of the means for containing the fluidizable medium includes a fluidizable cell 134 such as shown in FIGS. 7, 8, and 9 for example. Another embodiment of the means for containing the fluidizable medium preferably includes an embodiment of elastic wall 66, air permeable sheet 108, and diffuser board 52 such as shown in FIGS. *2b*, 4, and 12 for example.

What is claimed is:

1. A method of providing support to a patient, comprising:

(a) supporting a first portion of the patient on a first surface;

(b) supporting a second portion of the patient on a second surface formed by an air fluidizable mass of material; and (c) containing the fluidizable mass of material with an elastic interface member supporting the portion of the patient between said first portion and said second portion.

2. A method as in claim 1, wherein: said first surface includes said elastic interface member and is adjacent said second surface.

3. A method as in claim 1, wherein: one end of said first surface includes said elastic interface member and is coterminous with one end of said second surface.

4. A method as in claim 1, wherein:

said surfaces are non-overlapping with respect to each other.

5. A method of providing support to a patient, comprising:

(a) supporting a first portion of the patient on a first surface;

(b) supporting a different portion of the patient on a second surface formed by an air fluidizable mass of material;

(c) inclining the first portion of the patient by elevating one end of the first surface; and (d) reducing the level of fluidization of the mass of material forming the second surface.

6. A method as in claim 5, wherein: the level of fluidization is reduced until the mass of material is completely defluidized.

7. A method as in claim 5, further comprising:

after ceasing to elevate said one end of the first surface, increasing the level of fluidization of the mass of material to a selected level of fluidization.

8. A method as in claim 5, further comprising:

after ceasing to elevate the end of the first surface, increasing the level of fluidization of the mass of material for at least a brief period.

9. A method as in claim 8, wherein:

the duration of said brief period is no longer than is required to contour the mass of material for the support of the buttocks in the sitting position of the patient.

10. A method as in claim 8, wherein:

the duration of said brief period is in the range of ½ to 1½ seconds.

11. A method as in claim 5, further comprising:

regulating the rate of defluidization during elevation of the first surface so as to restrain the buttocks of the patient from moving in a direction toward the feet of the patient as weight is transferred against the buttocks.

12. A method as in claim 5, further comprising:

regulating the rate of defluidization during elevation of the first surface so as to restrain slipping or sliding of the buttocks that causes tissue damage to existing sacral skin grafts on the patient.

13. A method as in claim 5, wherein:

the mass of material is completely defluidized when the first surface begins elevating.

14. A method of providing support to a patient, comprising:

(a) supporting a first portion of the patient on a first surface;

(b) supporting a different portion of the patient on a second surface formed by an air fluidizable mass of material; and (c) wherein:

the first surface is formed by at least one air-inflated sack and pressurized air is used to support the upper torso, chest and head of the patient above the first surface.

15. A method of providing support to a patient, comprising:

(a) supporting a first portion of the patient on an articulatable surface;

(b) supporting a different portion of the patient by an air fluidized mass of material;

(c) inclining the first portion of the patient by elevating one end of the articulatable surface; and (d) reducing the level of fluidization of the mass of material.

16. A method as in claim 15, wherein:

the level of fluidization is reduced until the mass of material is completely defluidized.

17. A method as in claim 16, further comprising:

after ceasing to elevate the articulatable surface, increasing the level of fluidization of the mass of material for a period of time that is no longer than is required to contour the mass of material for the support of the buttocks in the sitting position of the patient.

18. A method as in claim 17, wherein:

the duration of said period of time is from ½ to 1½ seconds.

19. A method as in claim 15, further comprising:

regulating the rate of defluidization during elevation of the articulatable surface so as to restrain the buttocks of the patient from moving in a direction toward the feet of the patient as weight is transferred against the buttocks.

20. A method as in claim 15, further comprising:

regulating the rate of defluidization during elevation of the articulatable surface so as to restrain slipping or sliding of the buttocks that causes tissue damage to existing sacral skin grafts on the patient.

21. A method as in claim 15, wherein:

the mass of material is completely defluidized as soon as the articulatable surface begins elevating.

22. A method as in claim 15, further comprising:

using pressurized air to support the upper torso, chest and head of the patient above the articulatable surface.

23. A method of providing support to a patient, comprising:

(a) supporting the patient above the waist on an articulatable surface;

(b) supporting the buttocks of the patient in an air fluidized mass of material;

(c) inclining the head and chest of the patient by elevating the end of the surface closest to the head of the patient; and (d) defluidizing the mass of material at least partially during elevation of the surface.

24. A method as in claim 23, further comprising:

after ceasing to elevate the surface, fluidizing the mass of material for a brief period.

25. A method as in claim 24, wherein:

the duration of said brief period is no longer than is required to contour the mass of material for the support of the buttocks in the sitting position of the patient.

26. A method as in claim 23, further comprising:

regulating the rate of defluidization during elevation of the surface so as to restrain the buttocks of the patient from moving in a direction toward the feet of the patient as weight is transferred against the buttocks.

27. A method as in claim 23, further comprising:

regulating the rate of defluidization during elevation of the surface so as to restrain slipping or sliding of the buttocks that causes tissue damage to existing sacral skin grafts on the patient.

28. A method as in claim 23, further comprising:

using pressurized air to support the upper torso, chest and head of the patient above the flat surface.

29. A method of providing support to a patient, comprising:

(a) supporting the patient above the waist on an articulatable surface;

(b) supporting the buttocks of the patient in an air fluidized mass of material;

(c) inclining the head and chest of the patient by elevating the end of the surface closest to the head of the patient; and (d) completely defluidizing the mass of material at least beneath the buttocks of the patient before elevating the surface.

30. A method as in claim 29, further comprising:

after ceasing to elevate the surface, fluidizing the mass of material for a brief period.

31. A method as in claim 30, wherein:

the duration of said brief period is no longer than is required to contour the mass of material for the support of the buttocks in the sitting position of the patient.

32. A method as in claim 29, wherein:

pressurized air is used to support the upper torso, chest and head of the patient above the surface.

* * * * *